US009272864B2

(12) United States Patent
Dufort et al.

(10) Patent No.: US 9,272,864 B2
(45) Date of Patent: Mar. 1, 2016

(54) FINISHER TRANSPORT ASSEMBLY JAM ACCESS COVER FOR DIGITAL PRINTERS

(71) Applicant: Xerox Corporation, Norwalk, CT (US)

(72) Inventors: Ron Edward Dufort, Rochester, NY (US); Arthur Harold Kahn, Cohocton, NY (US); Brian Roy Ford, Walworth, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/296,617

(22) Filed: Jun. 5, 2014

(65) Prior Publication Data

US 2015/0352862 A1 Dec. 10, 2015

(51) Int. Cl.

| | |
|---|---|
| ***B65H 5/36*** | (2006.01) |
| ***B65H 5/06*** | (2006.01) |
| ***B41J 11/00*** | (2006.01) |
| ***B65H 1/04*** | (2006.01) |
| ***B65H 1/26*** | (2006.01) |

(52) U.S. Cl.

CPC ..... *B65H 5/062* (2013.01); *B41J 11/006* (2013.01); *B65H 1/04* (2013.01); *B65H 1/266* (2013.01); *B65H 5/068* (2013.01); *B65H 5/36* (2013.01); *B65H 2402/441* (2013.01); *B65H 2402/45* (2013.01); *B65H 2601/255* (2013.01); *B65H 2601/321* (2013.01)

(58) Field of Classification Search

CPC ..... B65H 5/062; B65H 5/36; B65H 2402/31; B65H 2402/35; B65H 2402/40; B65H 2402/441; B65H 2402/45; B65H 2404/1421; B65H 2404/14212; B65H 2404/144; B65H 2404/1442; B65H 2404/15212; B65H 2404/152; B65H 2407/33; B65H 2601/255; B65H 2601/321

See application file for complete search history.

(56) References Cited

U.S. PATENT DOCUMENTS

| | | | | |
|---|---|---|---|---|
| 4,361,399 | A * | 11/1982 | Sawada et al. | 355/75 |
| 5,203,217 | A * | 4/1993 | Buckley | 74/500.5 |
| 7,734,217 | B2 * | 6/2010 | Dobashi | 399/116 |

* cited by examiner

*Primary Examiner* — Michael McCullough
(74) *Attorney, Agent, or Firm* — Hoffmann & Baron, LLP

(57) ABSTRACT

A sheet jam access assembly in combination with a finisher transport assembly having a main transport cover, is used with a digital printer. First and second axles with idler nip rollers are mounted on the transport assembly for movement away from the process path. First and second drive nip rollers are mounted for driven rotation on the transport assembly. A jam access cover pivots on the main transport cover from a closed to an open position. First and second hinges each have a first outer leaf on the jam access cover connected by a hinge pin to an inner leaf which translates transverse to the process direction. The hinge axis is spaced apart from the cover axis. A cam plate base portion translates parallel to the process direction. First and second ramps adjacent the axles extend away from the base portion at an angle to the process direction. A slot extends through the first inner leaf at an angle to the process direction. A transfer pin attached to the base portion engages the slot to move the cam plate ramps, which engage the axles to raise the nip rollers and release the jammed sheet. A leaf spring detent holds the jam access cover open.

20 Claims, 17 Drawing Sheets

FINISHER TRANSPORT ASSEMBLY JAM ACCESS COVER FOR DIGITAL PRINTERS

TECHNICAL FIELD

The presently disclosed technologies relate to media sheet transport in a digital printer and, more particularly, are directed to a cover apparatus and method that allows easy access to free a jam in a media handling transport in a digital printer.

BACKGROUND

The Finisher Transport Assembly (FTA) of a printing system typically employs nip rollers for driving the media sheet (paper) along the process path. Idler nip rollers oppose drive nip rollers for moving, guiding and controlling the paper. A paper jam in the FTA requires opening a large, heavy main cover to clear the jam. The idler nip rollers and shafts are mounted on the transport main cover and are raised up to free the paper as the main cover is lifted. The rollers and shafts and the structure to support them result in significant weight, requiring counter-balancing of the main cover with costly springs and mechanisms. In addition, failure of these counterbalancing systems could result in the main cover slamming down on the user. In some printers, there may not be room to open the entire FTA cover—for example, if the marking engine or scanner is disposed above the FTA. Secure, releasable latching of a large main cover can require an elaborate mechanism with added cost.

Further problems arise in aligning the idler rollers with their drive counterparts. An unfavorable tolerance buildup can occur from the drive rollers, through the base support structure, through the hinge, through the cover structure to the idler rollers. This can cause the idler rollers to be out of alignment with the drive rollers. Uniform nip force is also difficult to maintain. These conditions can result in skew registration error of the paper. Hence, raising the entire main cover requires a design having more locating features and tighter tolerances, incurring increased cost, to ensure proper paper control. Not lifting the idler rollers would make jam removal difficult while the paper is clamped in the nips. On some machines, it becomes necessary to reach deep into the mechanism, grasp a jammed sheet sight unseen, and pull the sheet from the grasp of nip rollers.

Accordingly, it would be desirable to provide an apparatus capable of easy, one-handed access to a paper jam, while releasing the respective nips to aid in freeing the jam.

SUMMARY OF THE INVENTION

In one aspect, a jam access assembly in combination with a finisher transport assembly having a main transport cover, is used in connection with a digital printer. A media sheet is adapted for travel through the transport assembly in a process direction. The jam access assembly comprises at least one idler nip roller axle mounted on the transport assembly for movement away from the process path. At least one idler nip roller is mounted for rotation on the axle. At least one drive nip roller is mounted for driven rotation on the transport assembly, and operatively engages the idler nip roller.

A jam access cover is pivotally mounted on the finisher transport assembly for pivotal movement on a cover axis. The jam access cover pivots from a closed position at least partially covering the transport assembly to an open position projecting at an angle away from the transport assembly. At least one hinge has an inner leaf mounted on the transport assembly. The inner leaf translates generally transverse to the process direction. The hinge has an outer leaf mounted on the jam access cover for rotation about the cover axis. A hinge pin connects the outer leaf to the inner leaf. The hinge pin is centered on a hinge axis spaced apart from the cover axis. As the jam access cover pivots from the closed position to the open position, the hinge pin will move in a path generally transverse to the process direction, thereby causing translation of the inner leaf.

A cam plate has a base portion mounted on the transport assembly. The cam plate translates generally parallel to the process direction. The cam plate base portion is generally parallel to the inner leaf and closely adjacent to the inner leaf. The cam plate has a ramp adjacent the axle. The ramp extends away from the base portion at an angle to the process direction. As the cam plate moves generally parallel to the process direction, the ramp slidingly engages the axle. This causes the axle to move upward, thereby raising the idler nip roller away from the drive nip roller.

A slot extends through one of the cam plate base portion and the inner leaf. The slot is disposed at an angle to the process direction. A transfer pin is attached to one of the cam plate base portion and the inner leaf opposite the slot. The transfer pin is operatively received for sliding motion in the slot. As the inner leaf moves transverse to the process direction, reactive forces between the slot and the transfer pin will cause the cam plate to move generally parallel to the process direction. The ramp will cause the axle to move upward, thereby raising the idler nip roller away from the drive nip roller and releasing the media sheet.

In another aspect, a jam access assembly in combination with a finisher transport assembly having a main transport cover, is used in connection with a digital printer. A media sheet is adapted for travel through the transport assembly in a process direction. The jam access assembly comprises a first axle mounted on the transport assembly for movement away from the process path. The first axle extends between opposite ends, and has two first idler nip rollers. Each first idler nip roller is mounted for rotation on one end of the first axle. Two first drive nip rollers are mounted for driven rotation on the transport assembly. Each first drive nip roller operatively engages one first idler nip roller.

A second axle is mounted on the transport assembly for movement away from the process path. The second axle extends between opposite ends. The second axle is spaced apart from the first axle in the process direction. The second axle has two second idler nip rollers. Each second idler nip roller is mounted for rotation on one end of the second axle. Two second drive nip rollers are mounted for driven rotation on the transport assembly. Each second drive nip roller operatively engages one second idler nip roller.

A jam access cover is pivotally mounted on the finisher transport assembly for pivotal movement on a cover axis. The jam access cover pivots from a closed position at least partially covering the transport assembly to an open position projecting at an angle away from the transport assembly.

At least one hinge has an inner leaf mounted on the transport assembly. The inner leaf translates generally transverse to the process direction. The hinge has an outer leaf mounted on the jam access cover for rotation about the cover axis. A hinge pin connects the outer leaf to the inner leaf. The hinge pin is centered on a hinge axis spaced apart from the cover axis. As the jam access cover pivots from the closed position to the open position, the hinge pin will move in a path generally transverse to the process direction, thereby causing translation of the inner leaf.

A cam plate has a base portion mounted on the transport assembly. The cam plate translates generally parallel to the process direction. The cam plate base portion is generally parallel to the inner leaf and closely adjacent to the inner leaf. The cam plate has a first ramp on the cam plate adjacent the first axle. The first ramp extends away from the base portion at an angle to the process direction. The cam plate has a second ramp on the cam plate adjacent the second axle. The second ramp extends away from the base portion at an angle to the process direction.

A slot extends through one of the cam plate base portion and the inner leaf. The slot is disposed at an angle to the process direction. A transfer pin is attached to one of the cam plate base portion and the inner leaf opposite the slot. The transfer pin is operatively received for sliding motion in the slot. As the inner leaf moves transverse to the process direction, reactive forces between the slot and the transfer pin will cause the cam plate to move generally parallel to the process direction. The first ramp will slidingly engage the first axle, and the second ramp will slidingly engage the second axle. The first and second axles will move upward, thereby raising the first and second idler nip rollers away from the first and second drive nip rollers respectively, and releasing the media sheet.

In yet another aspect, a jam access assembly in combination with a finisher transport assembly having a main transport cover, is used in connection with a digital printer. A media sheet is adapted for travel through the transport assembly in a process direction. The jam access assembly comprises a first axle mounted on the transport assembly for movement away from the process path. The first axle extends between opposite ends and has two first idler nip rollers. Each first idler nip roller is mounted for rotation on one end of the first axle. Two first drive nip rollers are mounted for driven rotation on the transport assembly. Each first drive nip roller operatively engages one first idler nip roller.

A second axle is mounted on the transport assembly for movement away from the process path. The second axle extends between opposite ends. The second axle is spaced apart from the first axle in the process direction. The second axle has two second idler nip rollers. Each second idler nip roller is mounted for rotation on one end of the second axle. Two second drive nip rollers are mounted for driven rotation on the transport assembly. Each second drive nip roller operatively engages one second idler nip roller.

A jam access cover is pivotally mounted on the main transport cover for pivotal movement on a cover axis. The jam access cover pivots from a closed position at least partially covering the transport assembly to an open position projecting at an angle away from the transport assembly.

A first hinge has a generally planar first inner leaf mounted on the transport assembly. The first inner leaf translates generally transverse to the process direction. The first hinge has a first outer leaf mounted on the jam access cover for rotation about the cover axis. A first hinge pin connects the first outer leaf to the first inner leaf. The first hinge pin is centered on a first hinge axis spaced apart from the cover axis. As the jam access cover pivots from the closed position to the open position, the first hinge pin will move in a path generally transverse to the process direction, thereby causing translation of the first inner leaf.

A second hinge has a generally planar second inner leaf mounted on the transport assembly. The second inner leaf translates generally transverse to the process direction. The second hinge has a second outer leaf mounted on the jam access cover for rotation about the cover axis. A second hinge pin connects the second outer leaf to the second inner leaf. The second hinge pin is centered on a second hinge axis spaced apart from the cover axis. As the jam access cover pivots from the closed position to the open position, the second hinge pin will move in a path generally transverse to the process direction, thereby causing translation of the second inner leaf.

A cam plate has a generally planar base portion mounted on the transport assembly. The cam plate translates generally parallel to the process direction. The cam plate base portion is generally parallel to the first inner leaf and closely adjacent to the first inner leaf. The cam plate extends underneath the first and second axles. The cam plate has a first ramp on the cam plate adjacent the first axle. The first ramp extends away from the base portion at an angle to the process direction. The cam plate has a second ramp on the cam plate adjacent the second axle. The second ramp extends away from the base portion at an angle to the process direction.

A slot extends through one of the cam plate base portion and the first inner leaf. The slot is disposed at an angle to the process direction. A transfer pin is attached to one of the cam plate base portion and the first inner leaf opposite the slot. The transfer pin is operatively received for sliding motion in the slot. As the first inner leaf moves transverse to the process direction, reactive forces between the slot and the transfer pin will cause the cam plate to move generally parallel to the process direction. The first ramp will slidingly engage the first axle, and the second ramp will slidingly engage the second axle. The first and second axles will move upward, thereby raising the first and second idler nip rollers away from the first and second drive nip rollers respectively, and releasing the media sheet.

A bridge member is attached to the transport assembly and juxtaposed with the second inner leaf. A cantilever leaf spring is attached to the second inner leaf and is coextensive with the second inner leaf. The cantilever leaf spring has an inclined surface with an apex. The inclined surface is disposed adjacent the bridge member. As the second inner leaf moves transverse to the process direction, the inclined surface will slide against the bridge member. This will cause the cantilever leaf spring to flex resiliently away from the bridge member. The apex will pass the bridge member, and the cantilever leaf spring bias will hold the jam access cover in the open position as a detent.

In still another aspect, a method is disclosed for accessing a media sheet jam in a finisher transport assembly having a main transport cover, and is for use in connection with a digital printer. A media sheet is adapted for travel through the transport assembly in a process direction. The method comprises pivotally mounting a jam access cover on the main transport cover. The jam access cover is pivotally moved on a cover axis from a closed position at least partially covering the transport assembly to an open position projecting at an angle away from the transport assembly.

A generally planar first inner leaf of a first hinge is mounted on the transport assembly. A first outer leaf of the first hinge is mounted on the jam access cover for rotation about the cover axis. The first outer leaf is connected to the first inner leaf with a first hinge pin. The first hinge pin is centered on a first hinge axis spaced apart from the cover axis.

The first hinge pin is moved in a path generally transverse to the process direction, in response to the jam access cover pivoting from the closed position to the open position. The first inner leaf is translated generally transverse to the process direction with the first hinge pin.

A cam plate having a generally planar base portion is mounted on the transport assembly. The cam plate base portion is juxtaposed generally parallel and closely adjacent to the first inner leaf.

A slot is extended through one of the cam plate base portion and the first inner leaf. The slot is disposed at an angle to the process direction. A transfer pin is attached to one of the cam plate base portion and the first inner leaf opposite the slot. The transfer pin is operatively received for sliding motion in the slot. The cam plate is translated generally parallel to the process direction by reacting the transfer pin against the slot.

A first axle is mounted for movement away from the process path on the transport. The first axle extends between opposite ends. Two first idler nip rollers are mounted for rotation on the first axle. One first idler nip roller is mounted on each end of the first axle. Two first drive nip rollers are mounted for driven rotation on the transport assembly. Each first drive nip roller is operatively engaged with one first idler nip roller.

The cam plate is extended underneath the first axle. A first ramp is extended away from the cam plate base portion at an angle to the process direction adjacent the first axle. The first ramp slides against the first axle lifting the first axle, and thereby raising the first idler nip roller away from the first drive nip roller, and releasing the media sheet.

These and other aspects, objectives, features, and advantages of the disclosed technologies will become apparent from the following detailed description of illustrative embodiments thereof, which is to be read in connection with the accompanying drawings.

DETAILED DESCRIPTION

As used herein, a "printer," "printing assembly" or "printing system" refers to one or more devices used to generate "printouts" or a print outputting function, which refers to the reproduction of information on "substrate media" or "media substrate" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate to record and reproduce information, or other suitable processes for generating printouts, such as an ink jet process, a liquid ink process, a solid ink process, and the like. Also, such a printing system can print and/or handle either monochrome or color image data.

As used herein, "media substrate" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any media substrate in the form of a sheet amounts to a reasonable equivalent thereto. Also, the "leading edge" of a media substrate refers to an edge of the sheet that is furthest downstream in the process direction.

As used herein, a "media handling assembly" refers to one or more devices used for handling and/or transporting media substrate, including feeding, printing, finishing, registration and transport systems.

As used herein, the terms "process" and "process direction" refer to a procedure of moving, transporting and/or handling a substrate media sheet. The process direction is downstream along a flow path or process path that the media substrate sheet moves in during the process. The process direction is indicated herein by arrow 28. The embodiment shown and described herein discloses a generally horizontal process path. Alternative process paths and process directions are possible, for example, a process path disposed at an angle to the horizontal, up to vertical. Any and all process paths and process directions and are to be considered equivalent within the spirit and scope of the claims.

Figure 1:
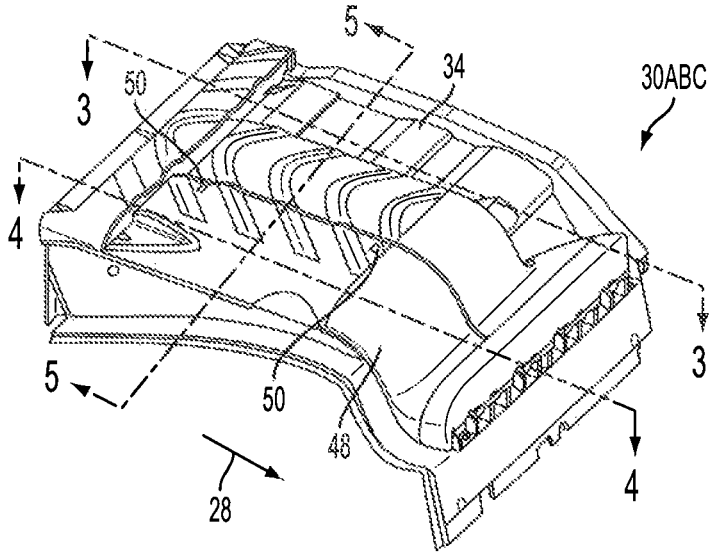
FIG. 1 is a top perspective view of a finisher transport assembly having a jam access cover constructed in accordance with the invention, showing the jam access cover in the closed position.
Figure 2:
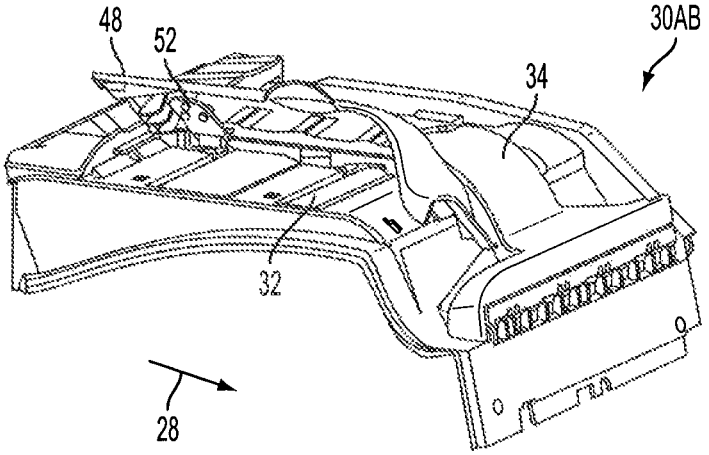
FIG. 2 is a top perspective view of the finisher transport assembly and jam access cover of FIG. 1, showing the jam access cover in the open position.
Figure 3:
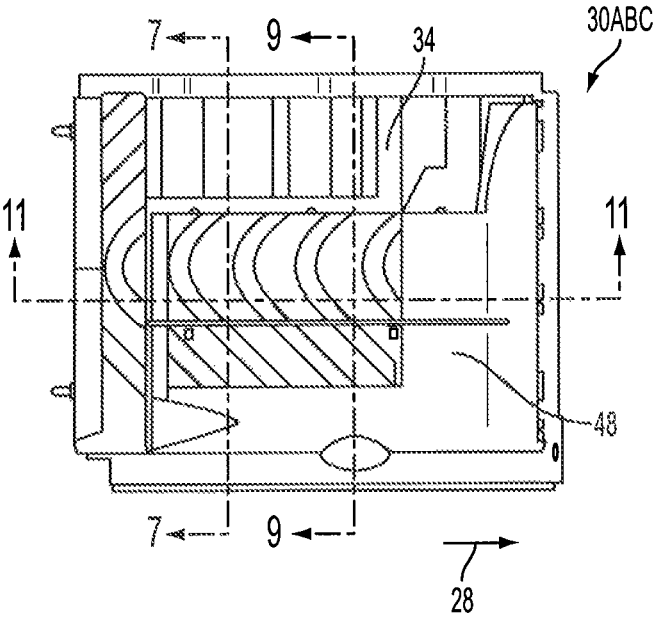
FIG. 3 is a top plan view of the finisher transport assembly and jam access cover of FIG. 1.

Describing now in further detail these exemplary embodiments with reference to the FIGS. 1-16 as described above, the finisher transport assembly and jam access cover is typically used in a select location or locations of the paper path or paths of various conventional media handling assemblies. Thus, only a portion of an exemplary media handling assembly path is illustrated herein. It should be noted that the drawings herein are not to scale. A jam access assembly 30A in combination with a finisher transport assembly 32 having a main transport cover 34, is used in connection with a digital printer, as shown in FIGS. 1-3. A media sheet (not shown), typically a sheet of paper, is adapted for travel through the transport assembly 32 along a process path in the process direction 28.

The jam access assembly 30A comprises at least one idler nip roller axle, or first axle 36, which is mounted for movement away from the process path, or in this embodiment upward sliding, on the transport 32. In all embodiments, the terms "vertical" and "upward" as used herein mean away from the process path. The first axle 36 extends between opposite ends. The first axle 36 carries two first idler nip rollers 38. Each first idler nip roller 38 is mounted for rotation on one end of the first axle 36. Two first drive nip rollers 40 are mounted for driven rotation on the transport 32. Each first drive nip roller 40 operatively engages one first idler nip roller 38.

A second axle 42 is mounted on the transport 32 for movement away from the process path. The second axle 42 extends between opposite ends. The second axle 42 is spaced apart from the first axle 36 in the process direction. The second axle 42 carries two second idler nip rollers 44. Each second idler nip roller 44 is mounted for rotation on one end of the second axle 42. Two second drive nip rollers 46 are mounted for driven rotation on the transport 32. Each second drive nip roller 46 operatively engages one second idler nip roller 44.

A jam access cover 48 is pivotally mounted on the finisher transport assembly 32, and preferably on the main transport cover 34. The jam access cover 48 pivots on a cover axis from a closed position, shown in FIGS. 1 & 5, at least partially covering the transport 32 to an open position, shown in FIGS. 2 & 6, projecting at an angle away from the transport 32. The jam access cover 48 pivots on cover hinges 50 which define the cover axis. The jam access cover 48 is manually lifted to reveal the paper sheet jam, and to gain easy access to the jam for removal. It is now unnecessary to lift the heavy main transport cover 34 for jam clearing. It is now unnecessary to disturb the drive nip rollers 40 & 46, which would skew registration.

At least one hinge, a first hinge 52, is provided. The first hinge 52 has a first inner leaf 54 mounted on the transport 32 in a generally horizontal plane. The first inner leaf 54 is mounted and constrained to allow translation, or straight-line sliding, generally transverse to, or across, the process direction 28. The first hinge 52 has a first outer leaf 56 mounted on the underside of the jam access cover 48 for rotation about the cover axis.

Figure 7:
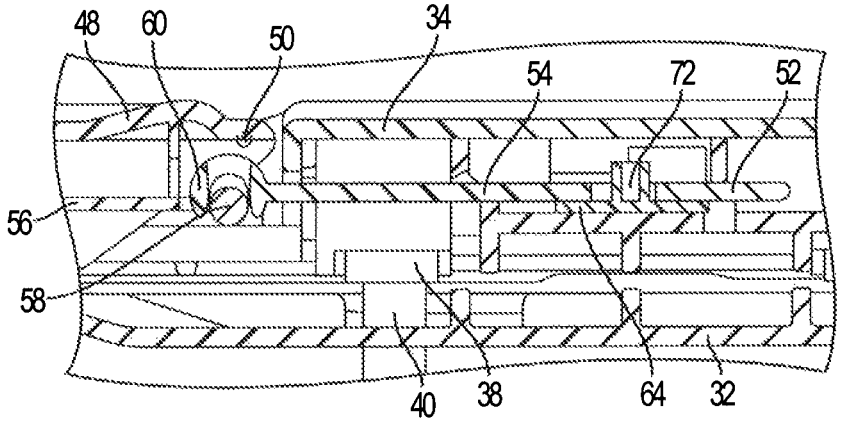
FIG. 7 is a side elevational cross-sectional, enlarged view of the finisher transport assembly and jam access cover of FIG. 1, taken along lines 7-7 of FIG. 3, and showing the jam access cover in the closed position.
Figure 8:
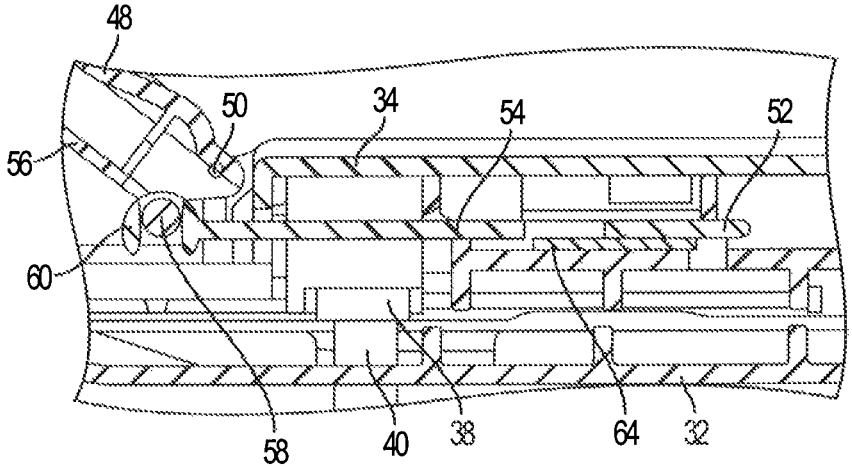
FIG. 8 is a side elevational cross-sectional, enlarged view of the finisher transport assembly and jam access cover of FIG. 1, taken along lines 7-7 of FIG. 3, and showing the jam access cover in the open position.
Figure 9:
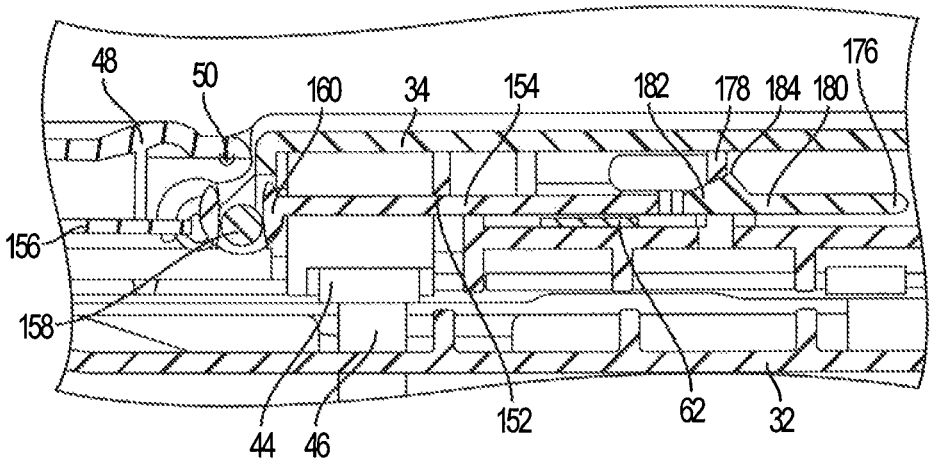
FIG. 9 is a side elevational cross-sectional, enlarged view of the finisher transport assembly and jam access cover of FIG. 1, taken along lines 9-9 of FIG. 3, and showing the jam access cover in the closed position.
Figure 10:
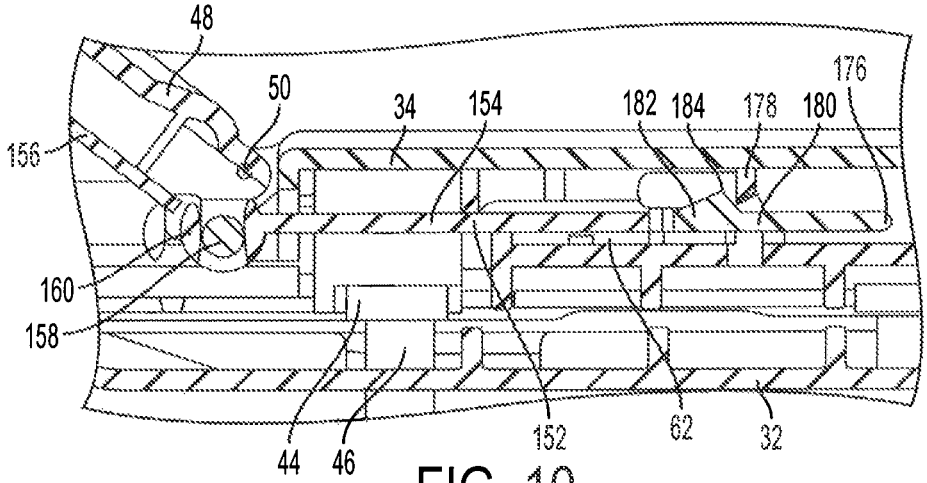
FIG. 10 is a side elevational cross-sectional, enlarged view of the finisher transport assembly and jam access cover of FIG. 1, taken along lines 9-9 of FIG. 3, and showing the jam access cover in the open position.
Figure 11:
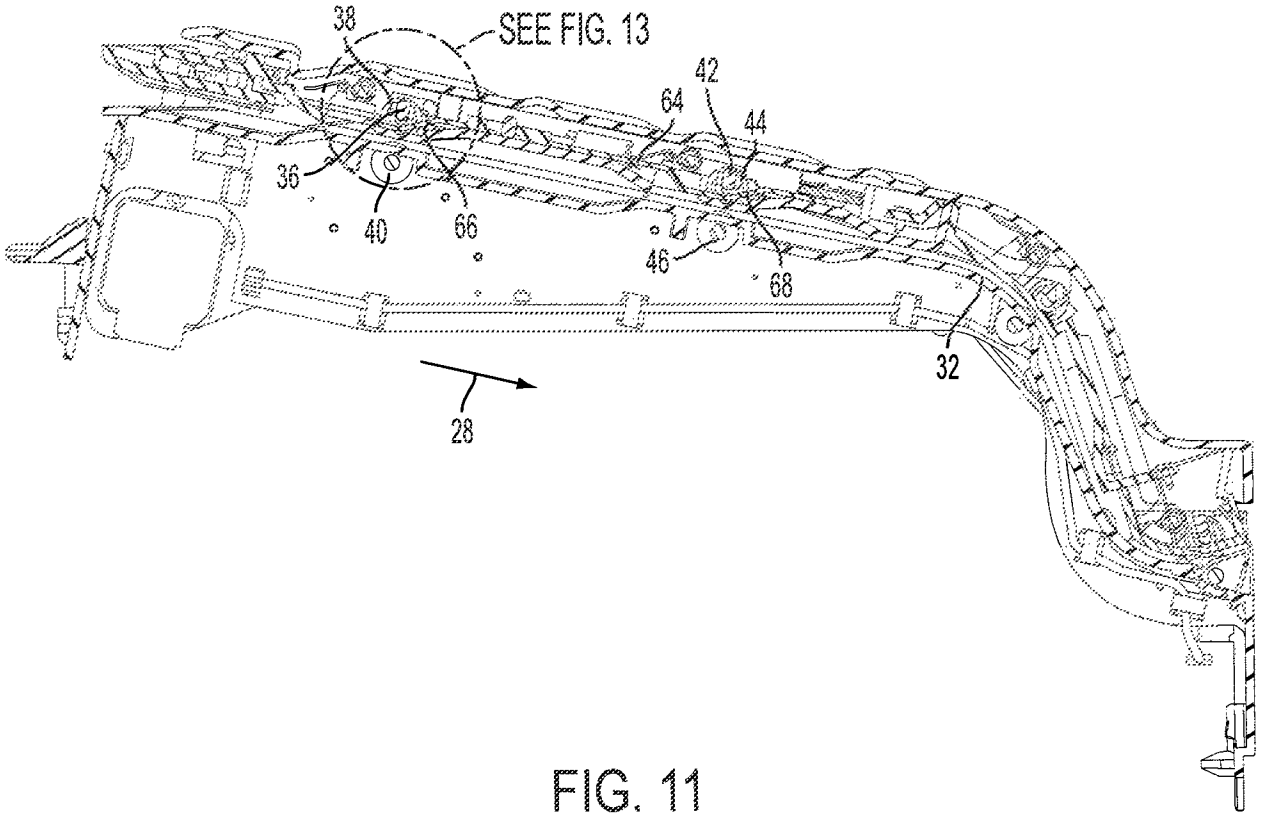
FIG. 11 is a front elevational cross-sectional view of the finisher transport assembly and jam access cover of FIG. 1, taken along lines 11-11 of FIG. 3, and showing the cam and idlers in the closed position.
Figure 12:
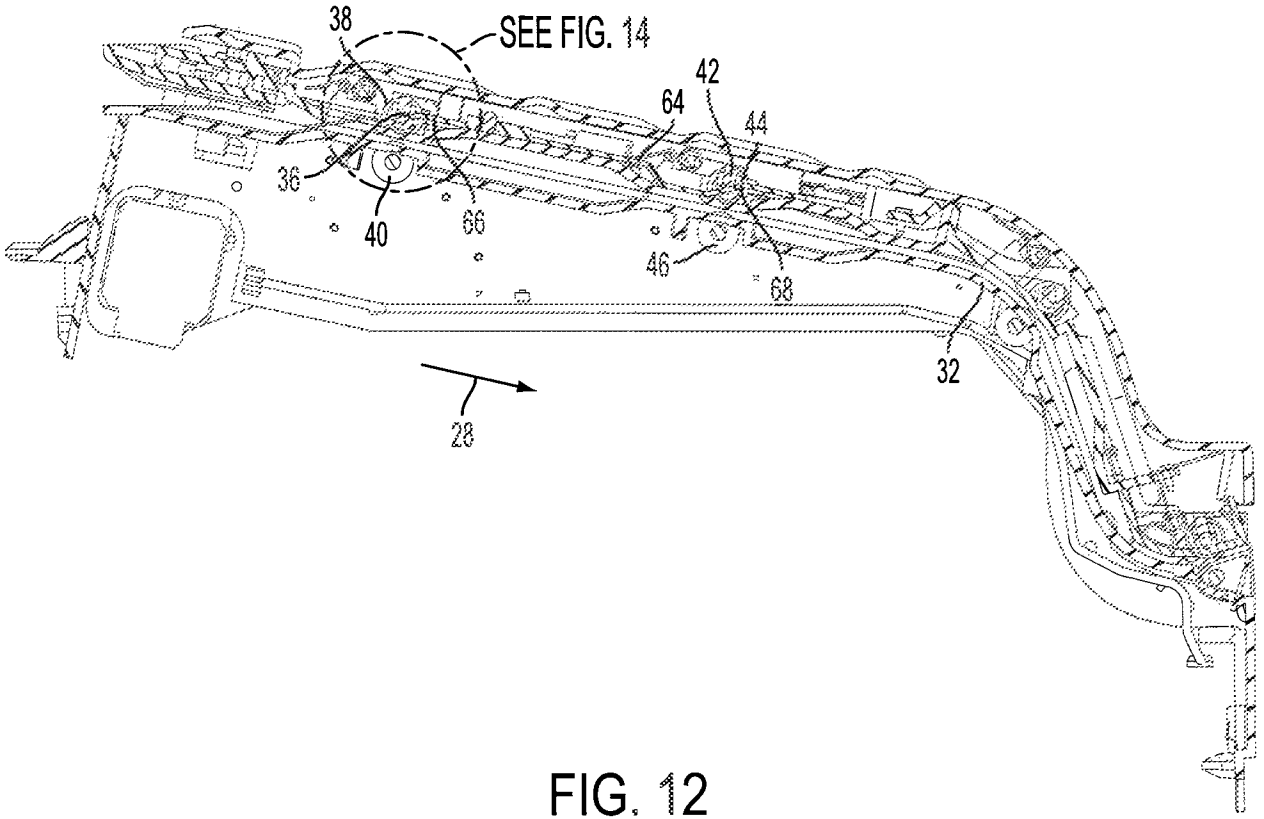
FIG. 12 is a front elevational cross-sectional view of the finisher transport assembly and jam access cover of FIG. 1, taken along lines 11-11 of FIG. 3, and showing the cam and idlers in the open position.
Figure 13:
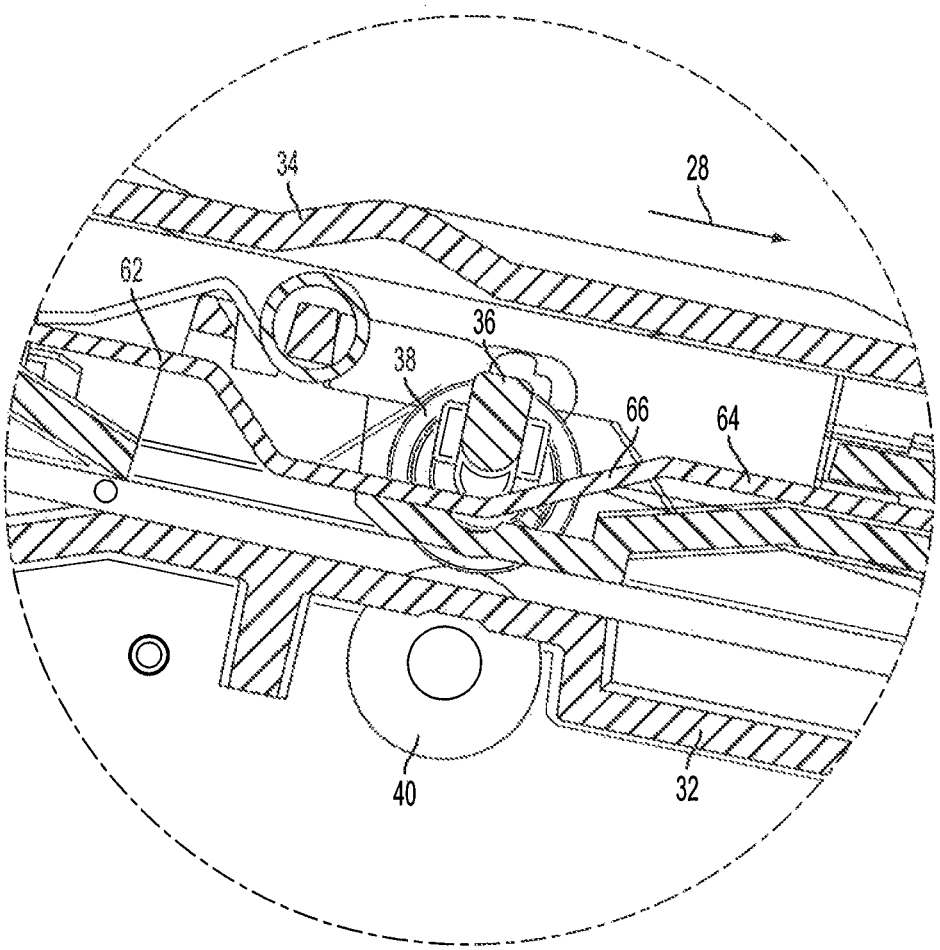
FIG. 13 is a front elevational cross-sectional, enlarged detail view of the finisher transport assembly and jam access cover of FIG. 1, taken at Det. 13 of FIG. 11, and showing the cam and idler in the closed position.
Figure 14:
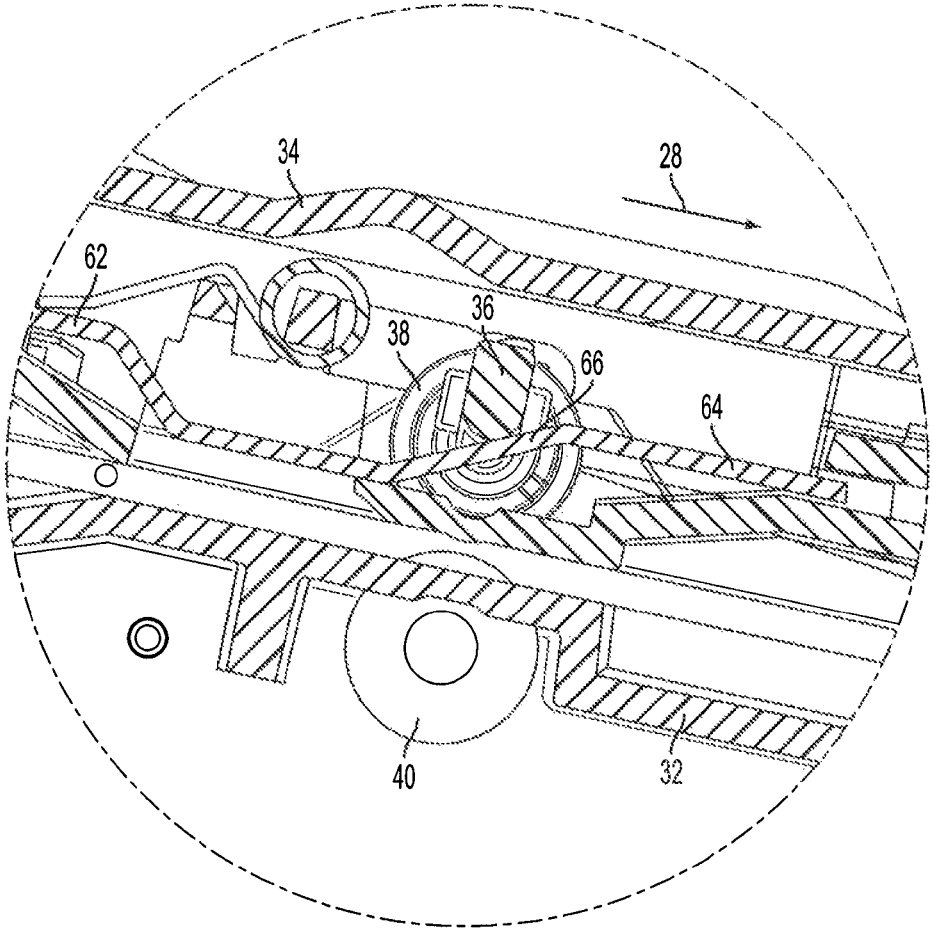
FIG. 14 is a front elevational cross-sectional, enlarged detail view of the finisher transport assembly and jam access cover of FIG. 1, taken at Det. 14 of FIG. 12, and showing the cam and idler in the open position.

A first hinge pin 58 connects the first outer leaf 56 to the first inner leaf 54. The first hinge pin 58 is centered on a first hinge axis spaced apart from the cover axis. Thus, as the jam access cover 48 pivots from the closed position to the open position, the first hinge pin 58 will move in a path generally transverse to the process direction. This causes the translation of the first inner leaf 54. The first hinge pin 58 is attached to either one of the first outer leaf 56 or the first inner leaf 54. A first journal 60 is attached to either one of the first outer leaf 56 or the first inner leaf 54, opposite that to which the hinge pin 58 is attached. The first journal 60 has a cross-section shaped approximately in a U-shape with two legs generally perpendicular to the attached leaf. The first hinge pin 58 is received in the first journal 60 for rotation and translation between the two legs. The U-shape allows the pin to move slightly in a direction at right angles to the leaf, providing clearance for arcuate motion. As shown in FIGS. 7 & 8, the first hinge pin 58 typically is mounted on the first outer leaf 56, and the first journal 60 is mounted on the first inner leaf 54. As the jam access cover 48 pivots, the first hinge pin 58 will move in an arcuate path generally centered about the cover axis, thereby causing translation of the first inner leaf 54.

It is to be understood that the first hinge pin 58 can be mounted on either the first outer leaf 56, or the first inner leaf 54, and that and the first journal 60 can be mounted on either the first outer leaf 56, or the first inner leaf 54. The mountings are to be taken as equivalent for all embodiments of the jam access assembly, within the spirit and scope of the claims.

A cam plate 62 has a base portion 64 mounted on the transport 32. The cam plate 62 translates generally parallel to the process direction. The cam plate base portion 64 is generally parallel to the inner leaf 54 and closely adjacent to the inner leaf 54. The cam plate 62 has a first ramp 66 adjacent the first axle 36. The first ramp 66 extends away from the base portion 64 at an angle to the process direction. The cam plate 62 has a second ramp 68 adjacent the second axle 42. The second ramp 68 extends away from the base portion 64 at an angle to the process direction.

A slot 70 extends through either one of the cam plate base portion 64 or the inner leaf 54. The slot 70 is disposed at an angle to the process direction. A transfer pin 72 is attached to either one of the cam plate base portion 64 or the inner leaf 54, opposite that through which the slot 70 extends. The transfer pin 72 is operatively received for sliding motion in the slot 70. Hence, as the inner leaf 54 moves transverse to the process direction, reactive forces between the slot 70 and the transfer pin 72 will cause the cam plate 62 to move generally parallel to the process direction. The first ramp 66 will slidingly engage the first axle 36, and the second ramp 68 will slidingly engage the second axle 42. The ramps 66 & 68 will lift the first and second axles 36 & 42 upward. The first 38 and second 44 idler nip rollers will be raised upward away from the first 40 and second 46 drive nip rollers respectively. Thus, raising the jam access cover 48 will reveal the jam and release the nips from the media sheet, allowing the jammed sheet to be easily removed. Conversely, lowering the jam access cover 48 will lower the nips back into contact, allowing normal sheet transfer to resume. As shown in FIGS. 4, 7, 15, and 16, the slot 70 extends through the inner leaf 54, and the transfer pin 72 is attached to the cam plate base portion 64.

It is to be understood that the slot 70 can extend through either the first inner leaf 54, or the cam plate base portion 64, and that and the transfer pin 72 can be mounted on either the first inner leaf 54, or the cam plate base portion 64. The several embodiments of the slot 70 and the transfer pin 72 combination are to be taken as equivalents for all embodiments of the jam access assembly, within the spirit and scope of the claims.

As shown in FIGS. 7, 8, 11, 12, 15, and 16, the first inner leaf 54 is disposed over the cam plate base portion 64. Alternatively, the cam plate base portion 64 can be disposed over the first inner leaf 54. This embodiment, though not shown, is to be taken as an equivalent for all embodiments of the jam access assembly, within the spirit and scope of the claims.

As shown in FIGS. 11-16, the first ramp 66 and second ramp 68 are disposed downstream of the first axle 36 and the second axle 42, respectively. The cam plate 62 moves upstream to engage the ramps with the axles and raise the nip rollers. In an alternative embodiment, the first ramp 66 and second ramp 68 can be disposed upstream of the first axle 36 and the second axle 42, respectively, with the ramp angles reversed. The cam plate 62 would move downstream to engage the ramps 66 & 68 with the axles 36 & 42 and raise the nip rollers. The angle of the slot 70 is reversed. This embodiment is not illustrated, but it is to be further understood to be an equivalent embodiment for all embodiments of the jam access assembly, within the spirit and scope of the claims.

Figure 4:
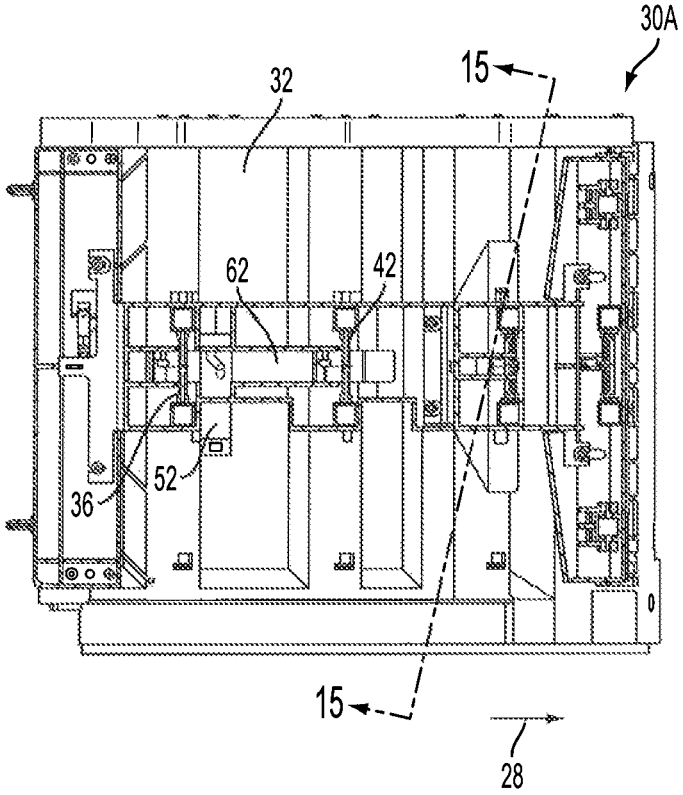
FIG. 4 is a top plan cross-sectional view of the finisher transport assembly and jam access cover of FIG. 1, with the main transport cover removed, showing the transport assembly.
Figure 5:
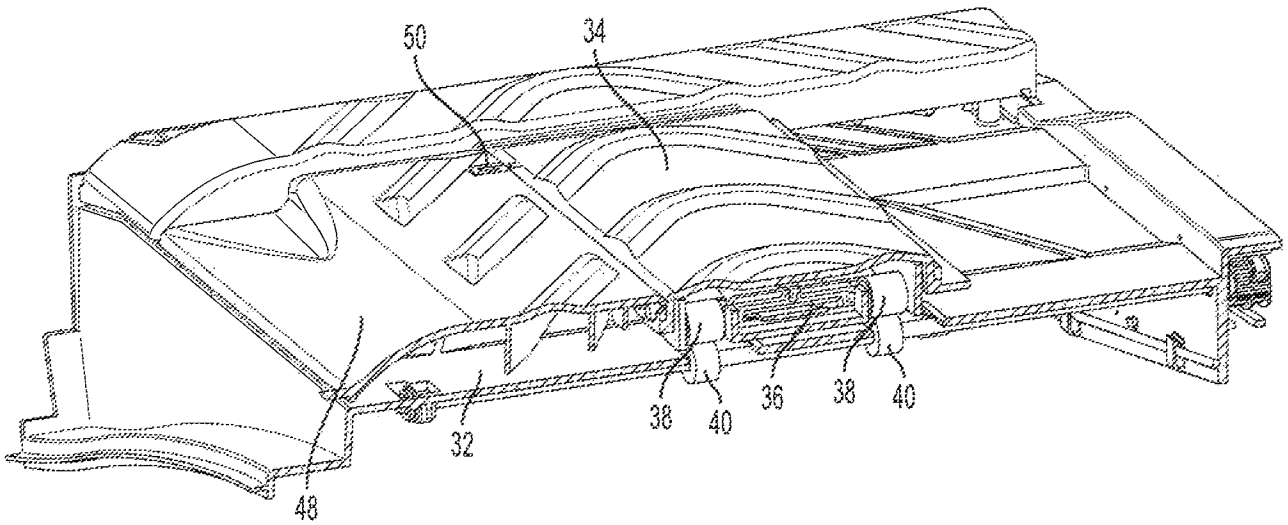
FIG. 5 is a top perspective cross-sectional view of the finisher transport assembly and jam access cover of FIG. 1, taken along lines 5-5 of FIG. 1, and showing the jag access cover in the closed position.
Figure 6:
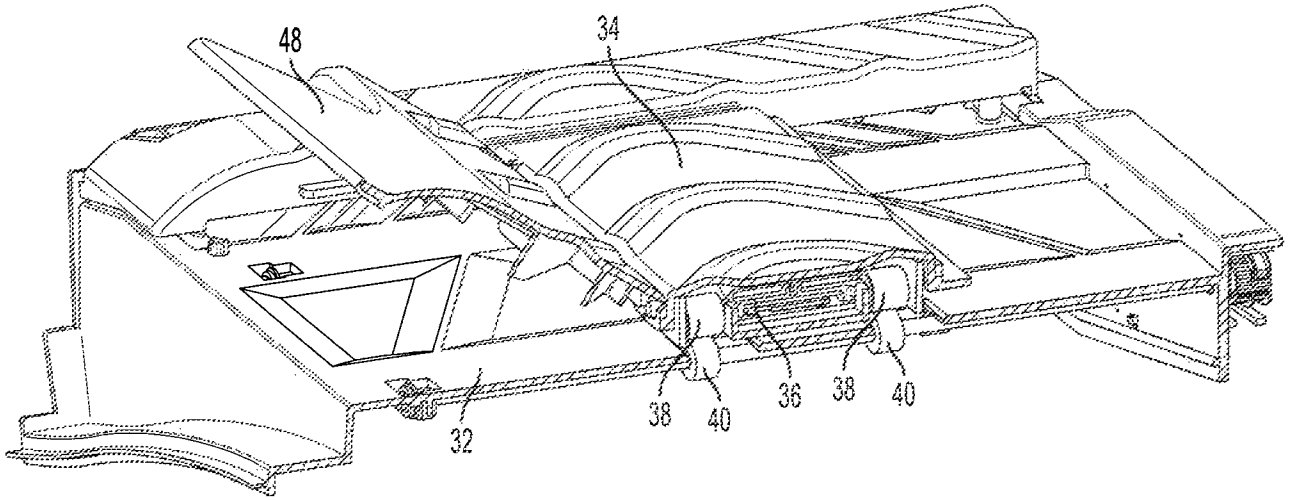
FIG. 6 is a top perspective cross-sectional view of the finisher transport assembly and jam access cover of FIG. 1, taken along lines 5-5 of FIG. 1, and showing the jam access cover in the open position.
Figure 15:
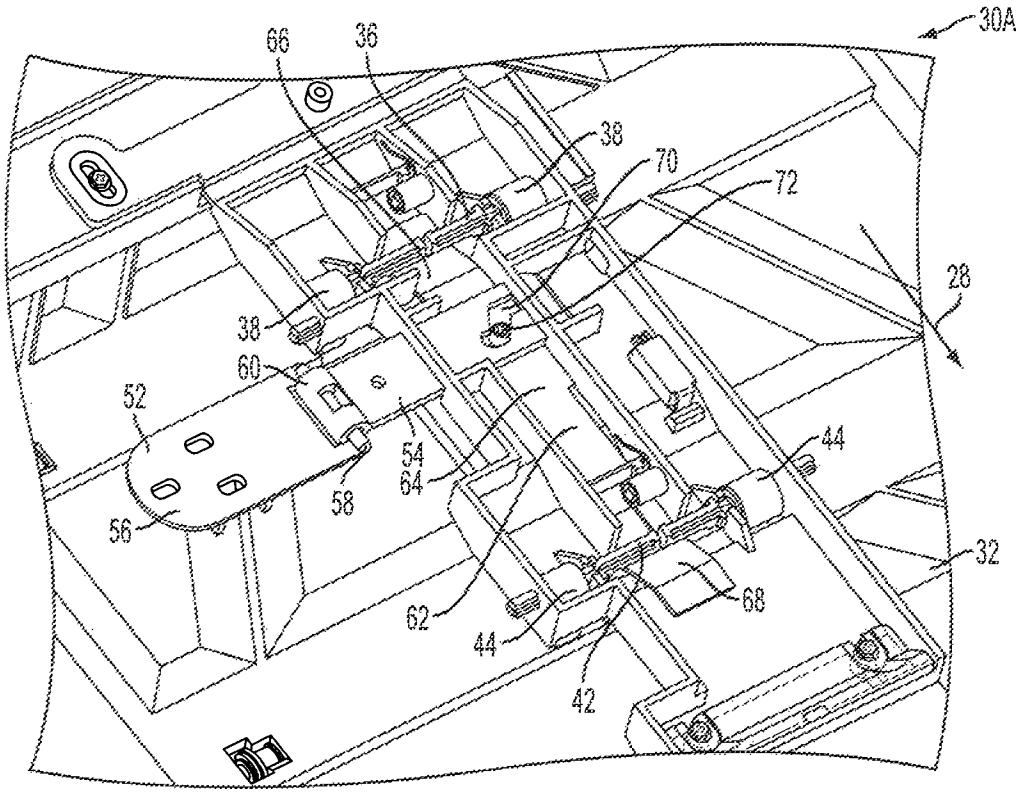
FIG. 15 is a top perspective cross-sectional view of the finisher transport assembly and jam access cover of FIG. 1, taken along lines 15-15 of FIG. 4, and showing the hinge, cam plate and idlers in the closed position.
Figure 16:
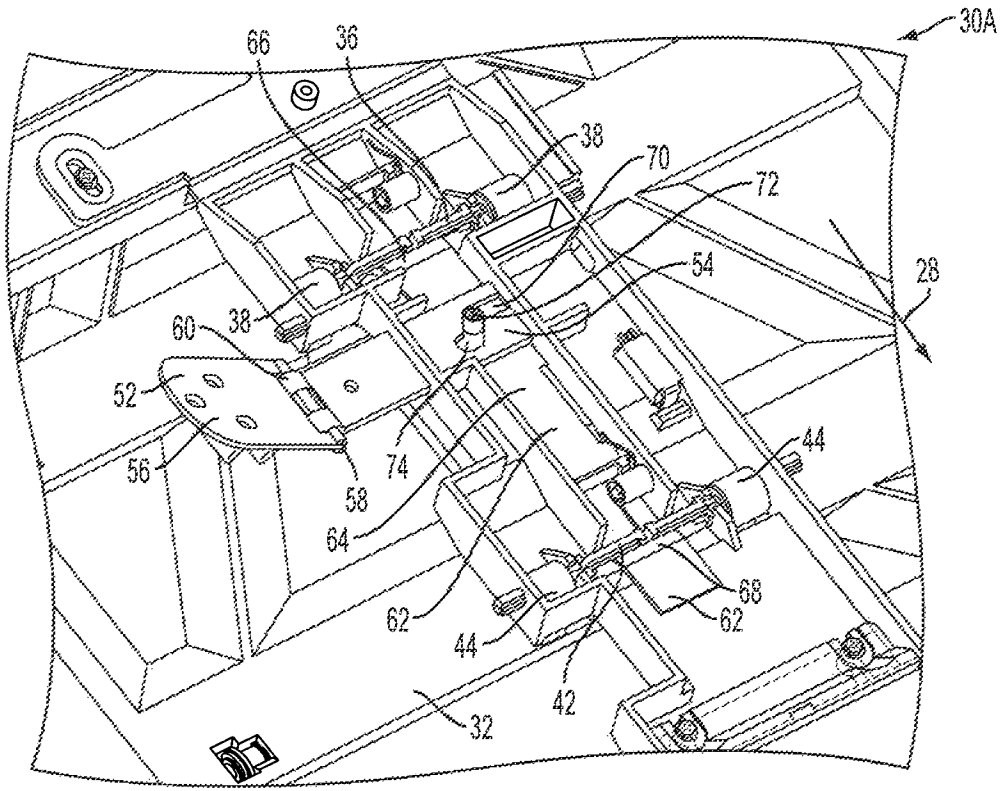
FIG. 16 is a top perspective cross-sectional view of the finisher transport assembly and jam access cover of FIG. 1, taken along lines 15-15 of FIG. 4, and showing the hinge, cam plate and idlers in the open position.

The slot 70 is shown in FIGS. 4, 15, and 16 to be a straight slot disposed at an angle of approximately 45° to the process direction. End portions 74 are shown to extend transversely from each end of the slot 70. These end portions 74 are optional, and serve to provide deadband at the open and closed positions of the jam access cover 48. The end portions 74 can be omitted. The angle of the slot to the process direction can be any angle. The shape of the slot 70 can be straight, or arcuate, or S-shaped, or any shape, according to design expediency. It is to be yet further understood that any angle and shape of the slot is an equivalent embodiment for all embodiments of the jam access assembly, within the spirit and scope of the claims.

Figure 17:
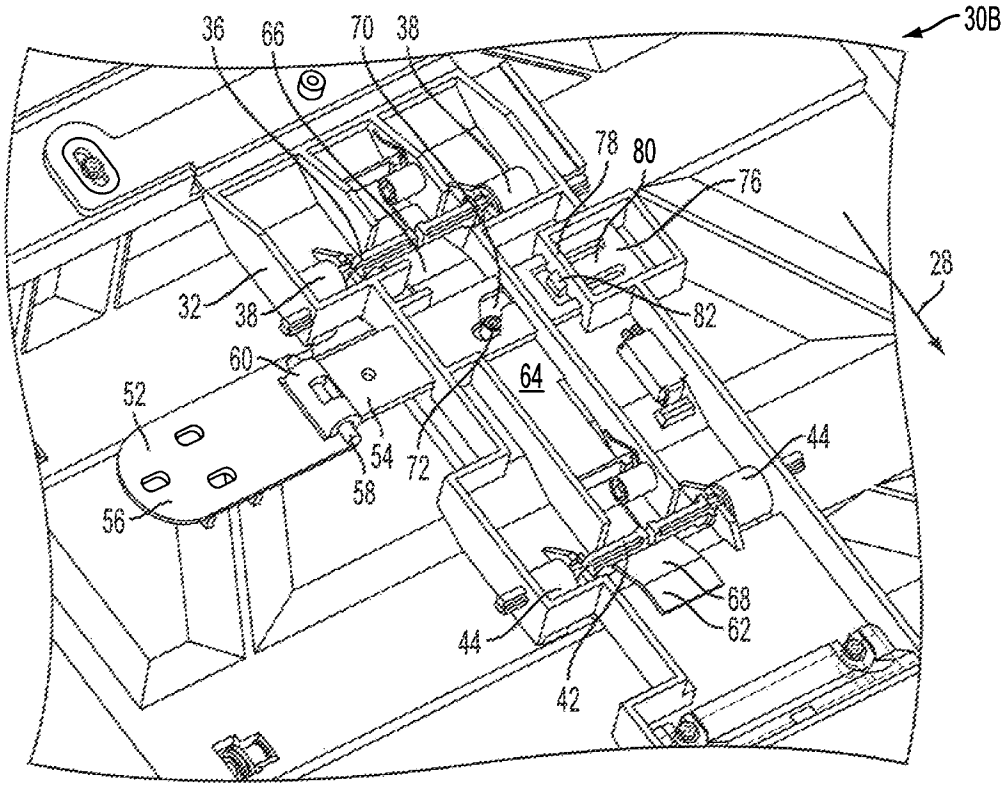
FIG. 17 is a top perspective cross-sectional view of a further finisher transport assembly having a jam access cover constructed in accordance with the invention, and showing the hinge, cam plate and idlers in the closed position.
Figure 18:
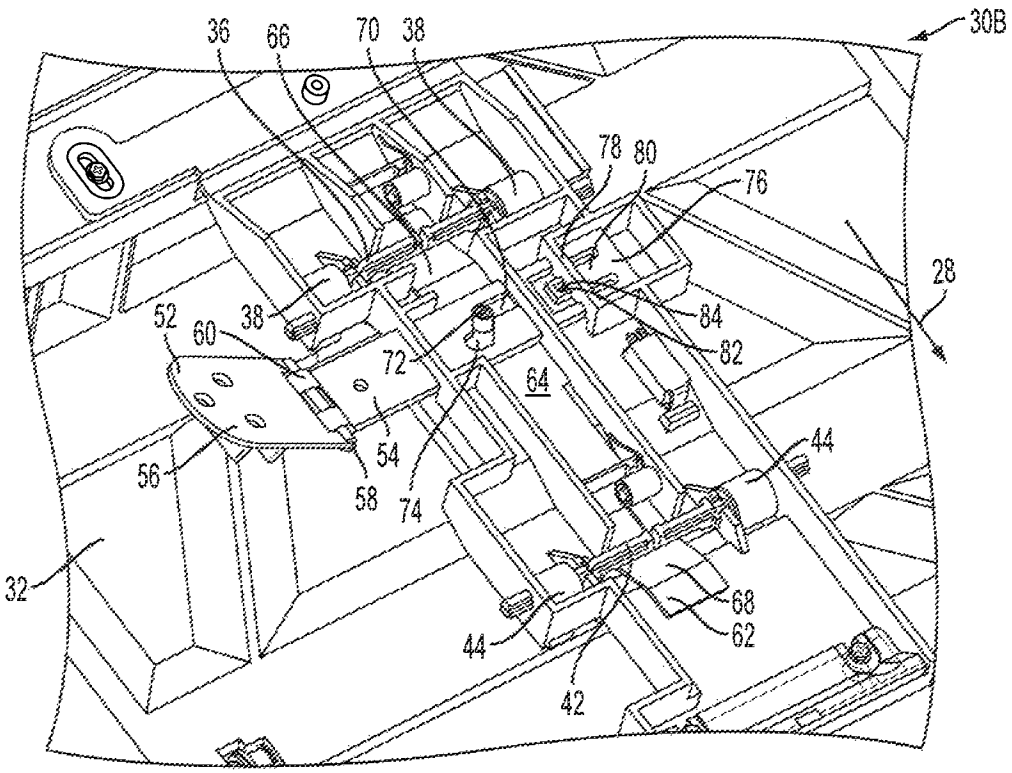
FIG. 18 is a top perspective cross-sectional view of the finisher transport assembly and jam access cover of FIG. 17, and showing the hinge, cam plate and idlers in the open position.

Referring now to FIGS. 17 and 18, as well as portions of FIGS. 1-8 and 11-14, a further embodiment of the jam access assembly is shown at 30B, and is similar to jam access assembly 30A described above, in that jam access assembly 30B in combination with a finisher transport assembly 32 having a main transport cover 34, is used in connection with a digital printer, as shown in FIGS. 1, 2, & 3. A media sheet (not shown), typically a sheet of paper, is adapted for travel through the transport assembly 32 in the process direction.

The jam access assembly 30B comprises at least one idler nip roller axle, or first axle 36, which is mounted on the transport 32 for movement away from the process path. In this embodiment, the movement will be generally vertical translation. The first axle 36 extends between opposite ends. The first axle 36 carries two first idler nip rollers 38. Each first idler nip roller 38 is mounted for rotation on one end of the first axle 36. Two first drive nip rollers 40 are mounted for driven rotation on the transport 32. Each first drive nip roller 40 operatively engages one first idler nip roller 38.

A second axle 42 is mounted on the transport 32 for movement away from the process path. The second axle 42 extends between opposite ends. The second axle 42 is spaced apart from the first axle 36 in the process direction. The second axle 42 carries two second idler nip rollers 44. Each second idler nip roller 44 is mounted for rotation on one end of the second axle 42. Two second drive nip rollers 46 are mounted for driven rotation on the transport 32. Each second drive nip roller 46 operatively engages one second idler nip roller 44.

A jam access cover 48 is pivotally mounted on the main transport cover 34. The jam access cover 48 pivots on a cover axis from a closed position, shown in FIGS. 1 & 5, closely adjacent the transport 32, to an open position shown in FIGS. 2 & 6, projecting at an angle away from the transport 32. The jam access cover 48 pivots on cover hinges 50 which define the cover axis.

At least one hinge, a first hinge 52, is provided. The first hinge 52 has a first inner leaf 54 mounted on the transport 32. The first inner leaf 54 is mounted and constrained to allow translation, or straight-line sliding, generally transverse to, or across, the process direction. The first hinge 52 has a first outer leaf 56 mounted on the underside of the jam access cover 48 for rotation about the cover axis.

A first hinge pin 58 connects the first outer leaf 56 to the first inner leaf 54. The first hinge pin 58 is centered on a first hinge axis spaced apart from the cover axis. Thus, as the jam access cover 48 pivots from the closed position to the open position, the first hinge pin 58 will move in a path generally transverse to the process direction. This causes the translation of the first inner leaf 54. The first hinge pin 58 is attached to either one of the first outer leaf 56 or the first inner leaf 54. A first journal 60 is attached to either one of the first outer leaf 56 or the first inner leaf 54, opposite that to which the hinge pin 58 is attached. The first journal 60 has a cross-section shaped approximately in a U-shape with two legs generally perpendicular to the attached leaf. The first hinge pin 58 is received in the first journal 60 for rotation and translation between the two legs. The U-shape allows the pin to move slightly in a direction at right angles to the leaf, providing clearance for arcuate motion.

A cam plate 62 has a base portion 64 mounted on the transport 32. The cam plate 62 translates generally parallel to the process direction. The cam plate base portion 64 is generally parallel to the inner leaf 54 and closely adjacent to the inner leaf 54. The cam plate 62 has a first ramp 66 adjacent the first axle 36. The first ramp 66 extends away from the base portion 64 at an angle to the process direction. The cam plate 62 has a second ramp 68 adjacent the second axle 42. The second ramp 68 extends away from the base portion 64 at an angle to the process direction.

A slot 70 extends through either one of the cam plate base portion 64 or the inner leaf 54. The slot 70 is disposed at an angle to the process direction. A transfer pin 72 is attached to either one of the cam plate base portion 64 or the inner leaf 54, opposite that through which the slot 70 extends. The transfer pin 72 is operatively received for sliding motion in the slot 70. Hence, as the inner leaf 54 moves transverse to the process direction, reactive forces between the slot 70 and the transfer pin 72 will cause the cam plate 62 to move generally parallel to the process direction. The first ramp 66 will slidingly engage the first axle 36, and the second ramp 68 will slidingly engage the second axle 42. The ramps 66 & 68 will lift the first and second axles 36 & 42 upward. The first 38 and second 44 idler nip rollers will be raised upward away from the first 40 and second 46 drive nip rollers respectively. Thus, raising the jam access cover 48 will reveal the jam and release the nips from the media sheet, allowing the jammed sheet to be easily removed. Conversely, lowering the jam access cover 48 will lower the nips back into contact, allowing normal sheet transfer to resume.

Jam access assembly 30B differs from jam access assembly 30A described above, in that jam access assembly 30B includes a detent 76 to hold the jam access cover 48 in the open position while removing the paper jam. A bridge member 78 is attached to the transport 32 and juxtaposed with the first inner leaf 54. A cantilever leaf spring 80 is attached to the first inner leaf 54 and is coextensive with the first inner leaf 54. The cantilever leaf spring 80 has an inclined surface 82 with an apex 84. The inclined surface 82 is disposed adjacent the bridge member 78. Thus, as the first inner leaf 54 moves transverse to the process direction 28, the inclined surface 82 will slide against the bridge member 78, causing the cantilever leaf spring 80 to flex resiliently away from the bridge member 78. The apex 84 will pass the bridge member 78, and the cantilever leaf spring bias will hold the jam access cover 48 in the open position as a detent 76. As shown in FIGS. 17 & 18, the bridge member 78 is disposed above the first inner leaf 54 across the direction that the first inner leaf 54 is moving. The cantilever leaf spring 80 flexes resiliently downward out of the plane of first inner leaf 54.

An alternative embodiment of the detent 76 would place the bridge member 78 disposed beneath the first inner leaf 54 across the direction that the first inner leaf 54 is moving. The cantilever leaf spring 80 would flex resiliently upward out of the plane of first inner leaf 54. Another alternative embodiment of the detent 76 would place the bridge member 78 attached to the first inner leaf 54. The cantilever leaf spring 80 would be attached to the transport 32. These embodiments are not illustrated, but it is to be understood that they are equivalent embodiments for all embodiments of the jam access assembly, within the spirit and scope of the claims.

Figure 19:
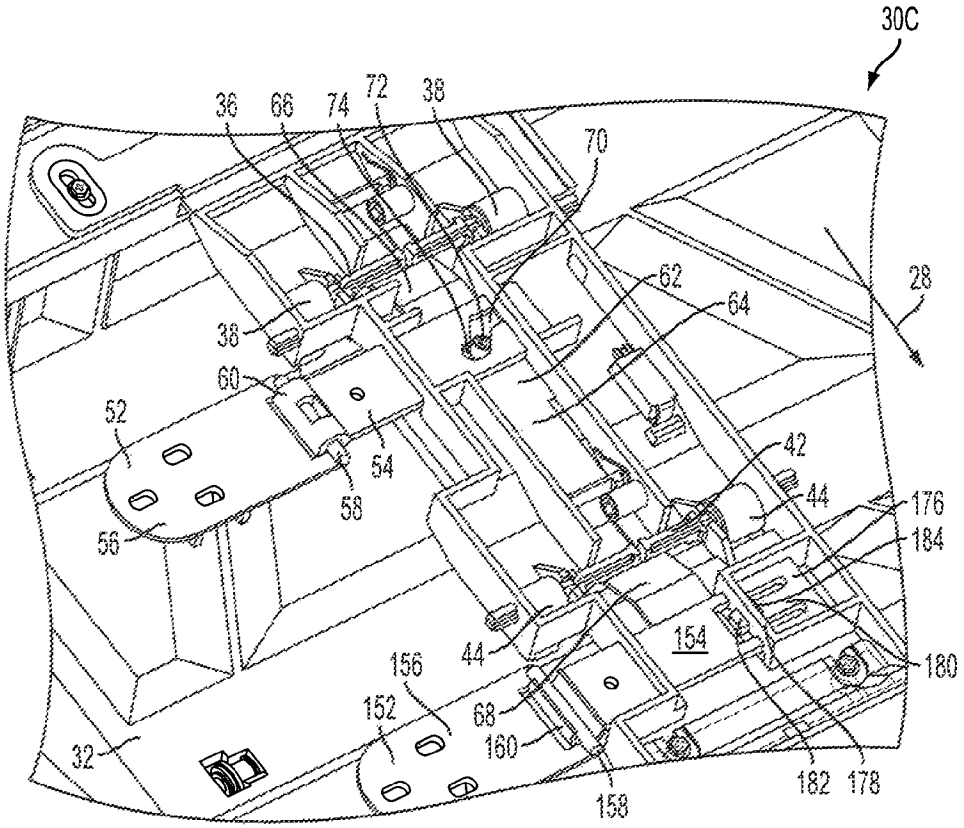
FIG. 19 is a top perspective cross-sectional view of a yet further finisher transport assembly having a jam access cover constructed in accordance with the invention, and showing the hinges, cam plate and idlers in the closed position.
Figure 20:
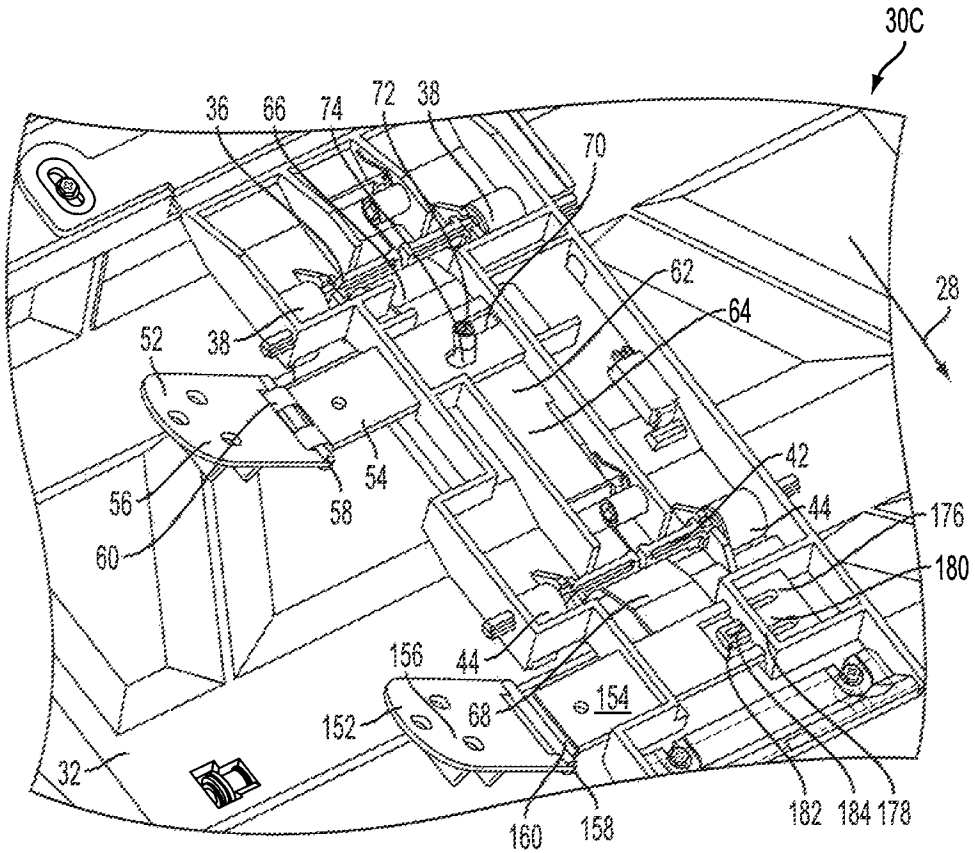
FIG. 20 is a top perspective cross-sectional view of the finisher transport assembly and jam access cover of FIG. 19, and showing the hinges, cam plate and idlers in the open position.

Turning now to FIGS. 19 and 20, as well as 9 and 10 and portions of FIGS. 1-8 and 11-14, a yet further embodiment of the jam access assembly is shown at 30C, and is similar to jam access assembly 30A described above, in that jam access assembly 30C in combination with a finisher transport assembly 32 having a main transport cover 34, is used in connection with a digital printer, as shown in FIGS. 1 & 3. A media sheet (not shown), typically a sheet of paper, is adapted for travel through the transport assembly 32 in the process direction 28.

The jam access assembly 30C comprises a first idler nip roller axle, or first axle 36, which is mounted on the transport 32 for movement away from the process path. The first axle 36 extends between opposite ends. The first axle 36 carries two first idler nip rollers 38. Each first idler nip roller 38 is mounted for rotation on one end of the first axle 36. Two first drive nip rollers 40 are mounted for driven rotation on the transport 32. Each first drive nip roller 40 operatively engages one first idler nip roller 38.

A second axle 42 is mounted on the transport 32 for movement away from the process path. The second axle 42 extends between opposite ends. The second axle 42 is spaced apart from the first axle 36 in the process direction. The second axle 42 carries two second idler nip rollers 44. Each second idler nip roller 44 is mounted for rotation on one end of the second axle 42. Two second drive nip rollers 46 are mounted for driven rotation on the transport 32. Each second drive nip roller 46 operatively engages one second idler nip roller 44.

A jam access cover 48 is pivotally mounted on the main transport cover 34. The jam access cover 48 pivots on a cover axis from a closed position, shown in FIGS. 1 & 5, at least partially covering the transport 32 to an open position, shown in FIGS. 2 & 6, projecting at an angle away from the transport 32. The jam access cover 48 pivots on cover hinges 50 which define the cover axis.

A first hinge 52 has a first inner leaf 54 mounted on the transport 32. The first inner leaf 54 is mounted and constrained to allow translation generally transverse to, or across, the process direction 28. The first hinge 52 has a first outer leaf 56 mounted on the underside of the jam access cover 48 for rotation about the cover axis.

A first hinge pin 58 connects the first outer leaf 56 to the first inner leaf 54. The first hinge pin 58 is centered on a first hinge axis spaced apart from the cover axis. Thus, as the jam access cover 48 pivots from the closed position to the open position, the first hinge pin 58 will move in a path generally transverse to the process direction 28. This causes the translation of the first inner leaf 54. The first hinge pin 58 is attached to either one of the first outer leaf 56 or the first inner leaf 54. A first journal 60 is attached to either one of the first outer leaf 56 or the first inner leaf 54, opposite that to which the hinge pin 58 is attached. The first journal 60 has a cross-section shaped approximately in a U-shape with two legs generally perpendicular to the attached leaf. The first hinge pin 58 is received in the first journal 60 for rotation and translation between the two legs. The U-shape allows the pin to move slightly in a direction at right angles to the leaf, providing clearance for arcuate motion.

A cam plate 62 has a base portion 64 mounted on the transport 32. The cam plate 62 translates generally parallel to the process direction. The cam plate base portion 64 is generally parallel to the inner leaf 54 and closely adjacent to the inner leaf 54. The cam plate 62 has a first ramp 66 adjacent the first axle 36. The first ramp 66 extends away from the base portion 64 at an angle to the process direction. The cam plate 62 has a second ramp 68 adjacent the second axle 42. The second ramp 68 extends away from the base portion 64 at an angle to the process direction.

A slot 70 extends through either one of the cam plate base portion 64 or the inner leaf 54. The slot 70 is disposed at an angle to the process direction. A transfer pin 72 is attached to either one of the cam plate base portion 64 or the inner leaf 54, opposite that through which the slot 70 extends. The transfer pin 72 is operatively received for sliding motion in the slot 70. Hence, as the inner leaf 54 moves transverse to the process direction, reactive forces between the slot 70 and the transfer pin 72 will cause the cam plate 62 to move generally parallel to the process direction. The first ramp 66 will slidingly engage the first axle 36, and the second ramp 68 will slidingly engage the second axle 42. The ramps 66 & 68 will lift the first and second axles 36 & 42 upward. The first 38 and second 44 idler nip rollers will be raised upward away from the first 40 and second 46 drive nip rollers respectively. Thus, raising the jam access cover 48 will reveal the jam and release the nips from the media sheet, allowing the jammed sheet to be easily removed. Conversely, lowering the jam access cover 48 will lower the nips back into contact, allowing normal sheet transfer to resume.

Jam access assembly 30C differs from jam access assembly 30A described above, in that jam access assembly 30C includes a second hinge 152 with a second inner leaf 154 mounted on the transport 32. The second inner leaf 154 is mounted and constrained to allow translation generally transverse to, or across, the process direction 28. The second hinge 152 is disposed downstream in the process direction 28 from the first hinge 52. The second hinge 152 has a second outer leaf 156 mounted on the underside of the jam access cover 48 for rotation about the cover axis.

A second hinge pin 158 connects the second outer leaf 156 to the second inner leaf 154. The second hinge pin 158 is centered on a second hinge axis spaced apart from the cover axis. Thus, as the jam access cover 48 pivots from the closed position to the open position, the second hinge pin 158 will move in a path generally transverse to the process direction 28. This causes the translation of the second inner leaf 154. The second hinge pin 158 is attached to either one of the second outer leaf 156 or the second inner leaf 154. A second journal 160 is attached to either one of the second outer leaf 156 or the second inner leaf 154, opposite that to which the second hinge pin 158 is attached. The second journal 160 has a cross-section shaped approximately in a U-shape with two legs generally perpendicular to the attached leaf. The second hinge pin 158 is received in the second journal 160 for rotation and translation between the two legs. The U-shape allows the pin to move slightly in a direction at right angles to the leaf, providing clearance for arcuate motion.

A detent 176 is provided to hold the jam access cover 48 in the open position while removing the paper jam. A bridge member 178 is attached to the transport 32 and juxtaposed with the second inner leaf 154. A cantilever leaf spring 180 is attached to the second inner leaf 154 and is coextensive with the second inner leaf 154. The cantilever leaf spring 180 has an inclined surface 182 with an apex 184. The inclined surface 182 is disposed adjacent the bridge member 178. Thus, as the second inner leaf 154 moves transverse to the process direction 28, the inclined surface 182 will slide against the bridge member 178, causing the cantilever leaf spring 180 to flex resiliently away from the bridge member 178. The apex 184 will pass the bridge member 178, and the cantilever leaf spring bias will hold the jam access cover 48 in the open position as a detent 176.

As shown in FIGS. 9, 10, 19 and 20, the bridge member 178 is disposed above the first inner leaf 154 across the direction that the first inner leaf 154 is moving. The cantilever leaf spring 180 flexes resiliently downward out of the plane of first inner leaf 154. An alternative embodiment of the detent 176 would place the bridge member 178 disposed beneath the first inner leaf 154 across the direction that the first inner leaf 154 is moving. The cantilever leaf spring 180 would flex resiliently upward out of the plane of first inner leaf 154. Another alternative embodiment of the detent 176 would place the bridge member 178 attached to the first inner leaf 154. The cantilever leaf spring 180 would be attached to the transport 32. These embodiments are not illustrated, but it is to be understood that they are equivalent embodiments for all embodiments of the jam access assembly, within the spirit and scope of the claims.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

| PART NO. | DESCRIPTION |
|---|---|
| 28 | process direction |
| 30 | jam access assembly |
| 32 | finisher transport assembly |
| 34 | main transport cover |
| 36 | first axle |

-continued

| PART NO. | DESCRIPTION |
|---|---|
| 38 | first idler nip rollers |
| 40 | first drive nip rollers |
| 42 | second axle |
| 44 | second idler nip rollers |
| 46 | second drive nip rollers |
| 48 | jam access cover |
| 50 | cover hinges |
| 52 | first hinge |
| 54 | first inner leaf |
| 56 | first outer leaf |
| 58 | first hinge pin |
| 60 | first journal |
| 62 | cam plate |
| 64 | cam plate base portion |
| 66 | cam plate first ramp |
| 68 | cam plate second ramp |
| 70 | slot |
| 72 | transfer pin |
| 74 | slot end portions |
| 76 | detent |
| 78 | bridge member |
| 80 | cantilever leaf spring |
| 82 | inclined surface |
| 84 | apex |
| 152 | second hinge |
| 154 | second inner leaf |
| 156 | second outer leaf |
| 158 | second hinge pin |
| 160 | second journal |
| 176 | detent |
| 178 | bridge member |
| 180 | cantilever leaf spring |
| 182 | inclined surface |
| 184 | apex |

What is claimed is:

1. A jam access assembly in combination with a finisher transport assembly having a main transport cover, for use in connection with a digital printer and a media sheet adapted for travel through the transport assembly along a process path in a process direction, the jam access assembly comprising:

at least one idler nip roller axle mounted on the transport assembly for movement away from the process path;

at least one idler nip roller mounted for rotation on the at least one axle;

at least one drive nip roller mounted for driven rotation on the transport assembly, and operatively engaging the at least one idler nip roller;

a jam access cover pivotally mounted on the finisher transport assembly for pivotal movement on a cover axis from a closed position at least partially covering the transport assembly to an open position projecting at an angle away from the transport assembly;

at least one hinge having an inner leaf mounted on the transport assembly for translation generally transverse to the process direction, the at least one hinge having an outer leaf mounted on the jam access cover for rotation about the cover axis;

a hinge pin connecting the outer leaf to the inner leaf, the hinge pin being centered on a hinge axis spaced apart from the cover axis, so that as the jam access cover pivots from the closed position to the open position, the hinge pin will move in a path generally transverse to the process direction, thereby causing translation of the inner leaf;

a cam plate having a base portion mounted on the transport assembly for translation generally parallel to the process direction, the cam plate base portion being generally parallel to the inner leaf and adjacent to the inner leaf, the cam plate having a ramp adjacent the at least one axle, the ramp extending away from the base portion at an angle to the process direction, so that as the cam plate moves generally parallel to the process direction, the ramp slidingly engages the at least one axle causing the at least one axle to move upward, thereby raising the at least one idler nip roller away from the at least one drive nip roller;

a slot through one of the cam plate base portion and the inner leaf, the slot being disposed at an angle to the process direction; and a transfer pin attached to one of the cam plate base portion and the inner leaf opposite the slot, the transfer pin being operatively received for sliding motion in the slot, so that as the inner leaf moves transverse to the process direction, reactive forces between the slot and the transfer pin will cause the cam plate to move generally parallel to the process direction, the ramp will cause the at least one axle to move upward, thereby raising the at least one idler nip roller away from the at least one drive nip roller and releasing the media sheet.

2. The jam access assembly of claim 1, further comprising:

the at least one idler nip roller axle includes a first axle extending between opposite ends;

the at least one idler nip roller includes two first idler nip rollers, each first idler nip roller being mounted for rotation on one end of the first axle; and the at least one drive nip roller includes two first drive nip rollers mounted for driven rotation on the transport assembly, each first drive nip roller operatively engaging one first idler nip roller.

3. The jam access assembly of claim 2, further comprising:

the at least one idler nip roller axle includes a second axle extending between opposite ends, the second axle being spaced apart from the first axle in the process direction;

the at least one idler nip roller includes two second idler nip rollers, each second idler nip roller being mounted for rotation on one end of the second axle; and the at least one drive nip roller includes two second drive nip rollers mounted for driven rotation on the transport assembly, each second drive nip roller operatively engaging one second idler nip roller.

4. The jam access assembly of claim 3, further comprising:

the cam plate ramp includes a first ramp on the cam plate adjacent the first axle, the first ramp extending away from the base portion at an angle to the process direction; and the cam plate ramp includes a second ramp on the cam plate adjacent the second axle, the second ramp extending away from the base portion at an angle to the process direction;

so that as the cam plate moves generally parallel to the process direction, the first ramp slidingly engages the first axle, the second ramp slidingly engages the second axle, causing the first and second axles to move upward, thereby raising the first and second idler nip rollers away from the first and second drive nip rollers, respectively.

5. The jam access assembly of claim 1, further comprising:

the at least one hinge includes a first hinge, the first hinge having a first inner leaf mounted on the transport assembly for translation generally transverse to the process direction, the first hinge having a first outer leaf mounted on the jam access cover for rotation about the cover axis;

the hinge pin includes a first hinge pin connecting the first outer leaf to the first inner leaf, the first hinge pin being centered on a first hinge axis spaced apart from the cover axis, so that as the jam access cover pivots from the closed position to the open position, the first hinge pin will move in a path generally transverse to the process direction, thereby causing translation of the first inner leaf;

the slot extends through one of the cam plate base portion and the first inner leaf, the slot being disposed at an angle to the process direction;

the transfer pin being attached to one of the cam plate base portion and the first inner leaf opposite the slot, the transfer pin being operatively received for sliding motion in the slot, so that as the first inner leaf moves transverse to the process direction, reactive forces between the slot and the transfer pin will cause the cam plate to move generally parallel to the process direction;

the at least one hinge includes a second hinge, the second hinge having a second inner leaf mounted on the transport assembly for translation generally transverse to the process direction, the second hinge having a second outer leaf mounted on the jam access cover for rotation about the cover axis;

the hinge pin includes a second hinge pin connecting the second outer leaf to the second inner leaf, the second hinge pin being centered on a second hinge axis spaced apart from the cover axis, so that as the jam access cover pivots from the closed position to the open position, the second hinge pin will move in a path generally transverse to the process direction, thereby causing translation of the second inner leaf;

a bridge member attached to one of the transport assembly and the second inner leaf; and a cantilever leaf spring attached to one of the transport assembly and the second inner leaf opposite to the bridge member, the cantilever leaf spring having an inclined surface with an apex, the inclined surface being disposed adjacent the bridge member, so that as the second inner leaf moves transverse to the process direction, the inclined surface will slide against the bridge member causing the cantilever leaf spring to flex resiliently away from the bridge member, the apex will pass the bridge member, and the cantilever leaf spring bias will hold the jam access cover in the open position as a detent.

6. The jam access assembly of claim 5, further comprising:

a first journal attached to one of the first outer leaf and the first inner leaf, the first journal having a cross-section shaped approximately in a U-shape with two legs generally perpendicular to the attached leaf, the first hinge pin being attached to the other one of the first outer leaf and the first inner leaf, the first hinge pin being received in the first journal for rotation and translation between the two legs; and a second journal attached to one of the second outer leaf and the second inner leaf, the second journal having a cross-section shaped approximately in a U-shape with two legs generally perpendicular to the attached leaf, the second hinge pin being attached to the other one of the second outer leaf and the second inner leaf, the second hinge pin being received in the second journal for rotation and translation between the two legs.

7. The jam access assembly of claim 6, further comprising:

the first hinge pin being mounted on the first outer leaf;

the first journal being mounted on the first inner leaf;

the first hinge pin being centered on the first hinge axis spaced apart from the cover axis, so that as the jam access cover pivots from the closed position to the open position, the first hinge pin will move in an arcuate path generally centered about the cover axis, thereby causing translation of the first inner leaf;

the second hinge pin being mounted on the second outer leaf;

the second journal being mounted on the second inner leaf; and the second hinge pin being centered on the second hinge axis spaced apart from the cover axis, so that as the jam access cover pivots from the closed position to the open position, the second hinge pin will move in an arcuate path generally centered about the cover axis, thereby causing translation of the second inner leaf.

8. The jam access assembly of claim 1, further comprising:

a bridge member attached to one of the transport assembly and the inner leaf; and a cantilever leaf spring attached to one of the transport assembly and the inner leaf opposite to the bridge member, the cantilever leaf spring having an inclined surface with an apex, the inclined surface being disposed adjacent the bridge member, so that as the inner leaf moves transverse to the process direction, the inclined surface will slide against the bridge member causing the cantilever leaf spring to flex resiliently away from the bridge member, the apex will pass the bridge member, and the cantilever leaf spring bias will hold the jam access cover in the open position as a detent.

9. The jam access assembly of claim 1, further comprising:

the slot extending through the first inner leaf; and the transfer pin being attached to the cam plate base portion, the transfer pin being operatively received for sliding motion in the slot.

10. A jam access assembly in combination with a finisher transport assembly having a main transport cover, for use in connection with a digital printer and a media sheet adapted for travel through the transport assembly along a process path in a process direction, the jam access assembly comprising:

a first axle mounted on the transport assembly for movement away from the process path, the first axle extending between opposite ends;

two first idler nip rollers, each first idler nip roller mounted for rotation on one end of the first axle;

two first drive nip rollers mounted for driven rotation on the transport assembly, each first drive nip roller operatively engaging one first idler nip roller;

a second axle mounted on the transport assembly for movement away from the process path, the second axle extending between opposite ends, the second axle being spaced apart from the first axle in the process direction;

two second idler nip rollers, each second idler nip roller mounted for rotation on one end of the second axle;

two second drive nip rollers mounted for driven rotation on the transport assembly, each second drive nip roller operatively engaging one second idler nip roller;

a jam access cover pivotally mounted on the finisher transport assembly for pivotal movement on a cover axis from a closed position at least partially covering the transport assembly to an open position projecting at an angle away from the transport assembly;

at least one hinge having an inner leaf mounted on the transport assembly for translation generally transverse to the process direction, the at least one hinge having an outer leaf mounted on the jam access cover for rotation about the cover axis;

a hinge pin connecting the outer leaf to the inner leaf, the hinge pin being centered on a hinge axis spaced apart from the cover axis, so that as the jam access cover pivots from the closed position to the open position, the hinge pin will move in a path generally transverse to the process direction, thereby causing translation of the inner leaf;

a cam plate having a base portion mounted on the transport assembly for translation generally parallel to the process direction, the cam plate base portion being generally parallel to the inner leaf and adjacent to the inner leaf;

a first ramp on the cam plate adjacent the first axle, the first ramp extending away from the base portion at an angle to the process direction;

a second ramp on the cam plate adjacent the second axle, the second ramp extending away from the base portion at an angle to the process direction;

a slot through one of the cam plate base portion and the inner leaf, the slot being disposed at an angle to the process direction; and a transfer pin attached to one of the cam plate base portion and the inner leaf opposite the slot, the transfer pin being operatively received for sliding motion in the slot, so that as the inner leaf moves transverse to the process direction, reactive forces between the slot and the transfer pin will cause the cam plate to move generally parallel to the process direction, the first ramp will slidingly engage the first axle, the second ramp will slidingly engage the second axle, causing the first and second axles to move upward, thereby raising the first and second idler nip rollers away from the first and second drive nip rollers respectively, and releasing the media sheet.

11. The jam access assembly of claim 10, further comprising:

the at least one hinge includes a first hinge, the first hinge having a first inner leaf mounted on the transport assembly for translation generally transverse to the process direction, the first hinge having a first outer leaf mounted on the jam access cover for rotation about the cover axis;

the hinge pin includes a first hinge pin connecting the first outer leaf to the first inner leaf, the first hinge pin being centered on a first hinge axis spaced apart from the cover axis, so that as the jam access cover pivots from the closed position to the open position, the first hinge pin will move in a path generally transverse to the process direction, thereby causing translation of the first inner leaf;

the slot extends through one of the cam plate base portion and the first inner leaf, the slot being disposed at an angle to the process direction;

the transfer pin being attached to one of the cam plate base portion and the first inner leaf opposite the slot, the transfer pin being operatively received for sliding motion in the slot, so that as the first inner leaf moves transverse to the process direction, reactive forces between the slot and the transfer pin will cause the cam plate to move generally parallel to the process direction;

the at least one hinge includes a second hinge, the second hinge having a second inner leaf mounted on the transport assembly for translation generally transverse to the process direction, the second hinge having a second outer leaf mounted on the jam access cover for rotation about the cover axis;

the hinge pin includes a second hinge pin connecting the second outer leaf to the second inner leaf, the second hinge pin being centered on a second hinge axis spaced apart from the cover axis, so that as the jam access cover pivots from the closed position to the open position, the second hinge pin will move in a path generally transverse to the process direction, thereby causing translation of the second inner leaf;

a bridge member attached to one of the transport assembly and the second inner leaf; and a cantilever leaf spring attached to one of the transport assembly and the second inner leaf opposite to the bridge member, the cantilever leaf spring having an inclined surface with an apex, the inclined surface being disposed adjacent the bridge member, so that as the second inner leaf moves transverse to the process direction, the inclined surface will slide against the bridge member causing the cantilever leaf spring to flex resiliently away from the bridge member, the apex will pass the bridge member, and the cantilever leaf spring bias will hold the jam access cover in the open position as a detent.

12. The jam access assembly of claim 10, further comprising:

a bridge member attached to one of the transport assembly and the inner leaf; and a cantilever leaf spring attached to one of the transport assembly and the inner leaf opposite to the bridge member, the cantilever leaf spring having an inclined surface with an apex, the inclined surface being disposed adjacent the bridge member, so that as the inner leaf moves transverse to the process direction, the inclined surface will slide against the bridge member causing the cantilever leaf spring to flex resiliently away from the bridge member, the apex will pass the bridge member, and the cantilever leaf spring bias will hold the jam access cover in the open position as a detent.

13. The jam access assembly of claim 11, further comprising:

a first journal attached to one of the first outer leaf and the first inner leaf, the first journal having a cross-section shaped approximately in a U-shape with two legs generally perpendicular to the attached leaf, the first hinge pin being attached to the other one of the first outer leaf and the first inner leaf, the first hinge pin being received in the first journal for rotation and translation between the two legs; and a second journal attached to one of the second outer leaf and the second inner leaf, the second journal having a cross-section shaped approximately in a U-shape with two legs generally perpendicular to the attached leaf, the second hinge pin being attached to the other one of the second outer leaf and the second inner leaf, the second hinge pin being received in the second journal for rotation and translation between the two legs.

14. The jam access assembly of claim 13, further comprising:

the first hinge pin being mounted on the first outer leaf;

the first journal being mounted on the first inner leaf;

the first hinge pin being centered on the first hinge axis spaced apart from the cover axis, so that as the jam access cover pivots from the closed position to the open position, the first hinge pin will move in an arcuate path generally centered about the cover axis, thereby causing translation of the first inner leaf;

the second hinge pin being mounted on the second outer leaf;

the second journal being mounted on the second inner leaf; and the second hinge pin being centered on the second hinge axis spaced apart from the cover axis, so that as the jam access cover pivots from the closed position to the open position, the second hinge pin will move in an arcuate path generally centered about the cover axis, thereby causing translation of the second inner leaf.

15. A jam access assembly in combination with a finisher transport assembly having a main transport cover, for use in connection with a digital printer and a media sheet adapted for travel through the transport assembly along a process path in a process direction, the jam access assembly comprising:

a first axle mounted on the transport assembly for movement away from the process path, the first axle extending between opposite ends;

two first idler nip rollers, each first idler nip roller mounted for rotation on one end of the first axle;

two first drive nip rollers mounted for driven rotation on the transport assembly, each first drive nip roller operatively engaging one first idler nip roller;

a second axle mounted on the transport assembly for movement away from the process path, the second axle extending between opposite ends, the second axle being spaced apart from the first axle in the process direction;

two second idler nip rollers, each second idler nip roller mounted for rotation on one end of the second axle;

two second drive nip rollers mounted for driven rotation on the transport assembly, each second drive nip roller operatively engaging one second idler nip roller;

a jam access cover pivotally mounted on the main transport cover for pivotal movement on a cover axis from a closed position least partially covering the transport assembly to an open position projecting at an angle away from the transport assembly;

a first hinge, the first hinge having a generally planar first inner leaf mounted on the transport assembly for translation generally transverse to the process direction, the first hinge having a first outer leaf mounted on the jam access cover for rotation about the cover axis;

a first hinge pin connecting the first outer leaf to the first inner leaf, the first hinge pin being centered on a first hinge axis spaced apart from the cover axis, so that as the jam access cover pivots from the closed position to the open position, the first hinge pin will move in a path generally transverse to the process direction, thereby causing translation of the first inner leaf;

a second hinge, the second hinge having a generally planar second inner leaf mounted on the transport assembly for translation generally transverse to the process direction, the second hinge having a second outer leaf mounted on the jam access cover for rotation about the cover axis;

a second hinge pin connecting the second outer leaf to the second inner leaf, the second hinge pin being centered on a second hinge axis spaced apart from the cover axis, so that as the jam access cover pivots from the closed position to the open position, the second hinge pin will move in a path generally transverse to the process direction, thereby causing translation of the second inner leaf;

a cam plate having a generally planar base portion mounted on the transport assembly for translation generally parallel to the process direction, the cam plate base portion being generally parallel to the first inner leaf and closely adjacent to the first inner leaf, the cam plate extending underneath the first and second axles;

a first ramp on the cam plate adjacent the first axle, the first ramp extending away from the base portion at an angle to the process direction;

a second ramp on the cam plate adjacent the second axle, the second ramp extending away from the base portion at an angle to the process direction;

a slot through one of the cam plate base portion and the first inner leaf, the slot being disposed at an angle to the process direction;

a transfer pin attached to one of the cam plate base portion and the first inner leaf opposite the slot, the transfer pin being operatively received for sliding motion in the slot, so that as the first inner leaf moves transverse to the process direction, reactive forces between the slot and the transfer pin will cause the cam plate to move generally parallel to the process direction, the first ramp will slidingly engage the first axle, the second ramp will slidingly engage the second axle, causing the first and second axles to move upward, thereby raising the first and second idler nip rollers away from the first and second drive nip rollers respectively, and releasing the media sheet;

a bridge member attached to the transport assembly and juxtaposed with the second inner leaf; and a cantilever leaf spring attached to the second inner leaf and coextensive with the second inner leaf, the cantilever leaf spring having an inclined surface with an apex, the inclined surface being disposed adjacent the bridge member, so that as the second inner leaf moves transverse to the process direction, the inclined surface will slide against the bridge member causing the cantilever leaf spring to flex resiliently away from the bridge member, the apex will pass the bridge member, and the cantilever leaf spring bias will hold the jam access cover in the open position as a detent.

16. The jam access assembly of claim 15, further comprising:

the slot extending through the first inner leaf; and the transfer pin being attached to the cam plate base portion, the transfer pin being operatively received for sliding motion in the slot.

17. A method for accessing a media sheet jam in a finisher transport assembly having a main transport cover, for use in connection with a digital printer and a media sheet adapted for travel through the transport assembly along a process path in a process direction, the method comprising:

pivotally mounting a jam access cover on the main transport cover, pivotally moving the jam access cover on a cover axis from a closed position at least partially covering the transport assembly to an open position projecting at an angle away from the transport assembly;

mounting a generally planar first inner leaf of a first hinge on the transport assembly for translation generally transverse to the process direction;

mounting a first outer leaf of the first hinge on the jam access cover for rotation about the cover axis;

connecting the first outer leaf to the first inner leaf with a first hinge pin centered on a first hinge axis spaced apart from the cover axis;

moving the first hinge pin in a path generally transverse to the process direction, in response to the jam access cover pivoting from the closed position to the open position;

translating the first inner leaf generally transverse to the process direction with the first hinge pin;

mounting a cam plate having a generally planar base portion on the transport assembly;

juxtaposing the cam plate base portion generally parallel and adjacent to the first inner leaf;

extending a slot through one of the cam plate base portion and the first inner leaf, and disposing the slot at an angle to the process direction;

attaching a transfer pin to one of the cam plate base portion and the first inner leaf opposite the slot, and operatively receiving the transfer pin for sliding motion in the slot;

translating the cam plate generally parallel to the process direction by reacting the transfer pin against the slot;

mounting a first axle on the transport assembly for movement away from the process path, and extending the first axle between opposite ends;

mounting two first idler nip rollers for rotation on the first axle, with one first idler nip roller being mounted on each end of the first axle;

mounting two first drive nip rollers for driven rotation on the transport assembly, and operatively engaging each first drive nip roller with one first idler nip roller;

extending the cam plate underneath the first axle;

extending a first ramp away from the cam plate base portion at an angle to the process direction adjacent the first axle;

sliding the first ramp against the first axle and lifting the first axle; and thereby raising the first idler nip roller away from the first drive nip roller, and releasing the media sheet.

18. The method of claim 17, further comprising:

mounting a second axle on the transport assembly for movement away from the process path, and extending the second axle between opposite ends;

mounting two second idler nip rollers for rotation on the second axle, with one second idler nip roller being mounted on each end of the second axle;

mounting two second drive nip rollers for driven rotation on the transport assembly, and operatively engaging each second drive nip roller with one second idler nip roller;

extending the cam plate underneath the second axle;

extending a second ramp away from the cam plate base portion at an angle to the process direction adjacent the second axle;

sliding the second ramp against the second axle and lifting the second axle; and thereby raising the second idler nip roller away from the second drive nip roller, and releasing the media sheet.

19. The method of claim 17, further comprising:

mounting a generally planar second inner leaf of a second hinge on the transport assembly for translation generally transverse to the process direction;

mounting a second outer leaf of the second hinge on the jam access cover for rotation about the cover axis;

connecting the second outer leaf to the second inner leaf with a second hinge pin centered on a second hinge axis spaced apart from the cover axis;

moving the second hinge pin in a path generally transverse to the process direction, in response to the jam access cover pivoting from the closed position to the open position;

translating the second inner leaf generally transverse to the process direction with the second hinge pin;

attaching a bridge member to one of the transport assembly and the second inner leaf;

attaching a cantilever leaf spring to one of the transport assembly and the second inner leaf opposite to the bridge member, the cantilever leaf spring having an inclined surface with an apex;

sliding the inclined surface against the bridge member, causing the cantilever leaf spring to flex resiliently away from the bridge member, with the apex passing the bridge member; and holding the jam access cover in the open position with the cantilever leaf spring bias as a detent.

20. The method of claim 17, further comprising:

attaching a bridge member to one of the transport assembly and the inner leaf;

attaching a cantilever leaf spring to one of the transport assembly and the inner leaf opposite to the bridge member, the cantilever leaf spring having an inclined surface with an apex;

sliding the inclined surface against the bridge member, causing the cantilever leaf spring to flex resiliently away from the bridge member, with the apex passing the bridge member; and holding the jam access cover in the open position with the cantilever leaf spring bias as a detent.

* * * * *